US011821634B2

(12) United States Patent
Zheng

(10) Patent No.: US 11,821,634 B2
(45) Date of Patent: Nov. 21, 2023

(54) SLIM RANGE HOOD

(71) Applicant: FOSHAN SHUNDE MIDEA WASHING APPLIANCES MANUFACTURING CO., LTD., Foshan (CN)

(72) Inventor: Zhibiao Zheng, Foshan (CN)

( * ) Notice: Subject to any disclaimer, the term of this patent is extended or adjusted under 35 U.S.C. 154(b) by 0 days.

(21) Appl. No.: 17/725,507

(22) Filed: Apr. 20, 2022

(65) Prior Publication Data

US 2023/0144096 A1 May 11, 2023

(30) Foreign Application Priority Data

Nov. 8, 2021 (CN) ..... 202111315348.6

(51) Int. Cl.
*F24C 15/20* (2006.01)

(52) U.S. Cl.
CPC ..... *F24C 15/2035* (2013.01)

(58) Field of Classification Search
USPC ..... 126/299 R, 299 D
See application file for complete search history.

(56) References Cited

U.S. PATENT DOCUMENTS 5,599,229 A * 2/1997 Claunch ..... F24F 13/26 34/492
8,783,245 B2 * 7/2014 Saraf ..... F24C 15/2021 126/299 R
10,060,634 B2 * 8/2018 Jiang ..... F04D 29/00
10,578,316 B2 * 3/2020 Jiang ..... F24C 15/2092
2007/0015455 A1 * 1/2007 Knight ..... F24F 13/06 454/292
2016/0318614 A1 * 11/2016 Bultemeier ..... F24F 13/06
2021/0215350 A1 * 7/2021 Kim ..... F24C 15/2035
2021/0396394 A1 * 12/2021 Woods ..... F24C 15/2035

FOREIGN PATENT DOCUMENTS

CN 201476129 U 5/2010
WO 2019061308 A1 4/2019

OTHER PUBLICATIONS

Extended European Search Report dated Sep. 16, 2022 for EP Application No. 22167998.7.

* cited by examiner

*Primary Examiner* — Ko-Wei Lin
(74) *Attorney, Agent, or Firm* — KILPATRICK TOWNSEND & STOCKTON, LLP

(57) ABSTRACT

Various embodiments provide a slim range hood, including: a box body having an internal circulation air outlet; and a fan assembly arranged in the box body and including a volute and an air guide cover. The volute includes an air inlet part and a first air outlet part connected to an air outlet of the air inlet part. The air guide cover is detachably mounted at an air outlet of the first air outlet part and is configured to guide an air flow sucked in by the fan assembly to the internal circulation air outlet. With the slim range hood, a design of matching the volute with different air guide covers is realized by mounting the detachable air guide cover at the first air outlet part, different product structure sizes and air outlets of different sizes are satisfied, and different types of products have the same core component.

14 Claims, 20 Drawing Sheets

SLIM RANGE HOOD

CROSS-REFERENCES TO RELATED APPLICATIONS

The present application claims benefit of Chinese patent application No. 202111315348.6, filed with CNIPA on Nov. 8, 2021, the contents of which are hereby incorporated by reference in its entirety.

FIELD

The present disclosure relates to the field of range hood technologies, and more particularly, to a slim range hood.

BACKGROUND

A slim range hood is mainly featured with its slimness and mounting under a cupboard. Due to differentiated user needs, such products have different appearances and different sizes.

SUMMARY

Embodiments of the present disclosure provide a slim range hood.

A slim range hood according to an embodiment of the present disclosure includes: a box body having an internal circulation air outlet; and a fan assembly arranged in the box body and including a volute and an air guide cover. The volute includes an air inlet part and a first air outlet part connected to an air outlet of the air inlet part. The air guide cover is detachably mounted at an air outlet of the first air outlet part and is configured to guide an air flow sucked in by the fan assembly to the internal circulation air outlet.

With the slim range hood, a design of matching the volute with different air guide covers is realized by mounting the detachable air guide cover on the first air outlet part, different product structure sizes and air outlets of different sizes are satisfied, and different types of products can have the same core component. Therefore, high standardization is provided, the development investment is low, and the development cycle is short, which are conducive to expansion of product series and iterative upgrade of product performance.

Additional embodiments of the present disclosure will be given in part in the following description, or become apparent at least in part from the following description, or can be learned from practicing of the present disclosure.

BRIEF DESCRIPTION OF THE DRAWINGS

The above and/or additional embodiments of the present disclosure will become apparent and readily understandable from the following description of embodiments taken in conjunction with the accompanying drawings, in which.

DETAILED DESCRIPTION OF THE DISCLOSURE

Figure 1:
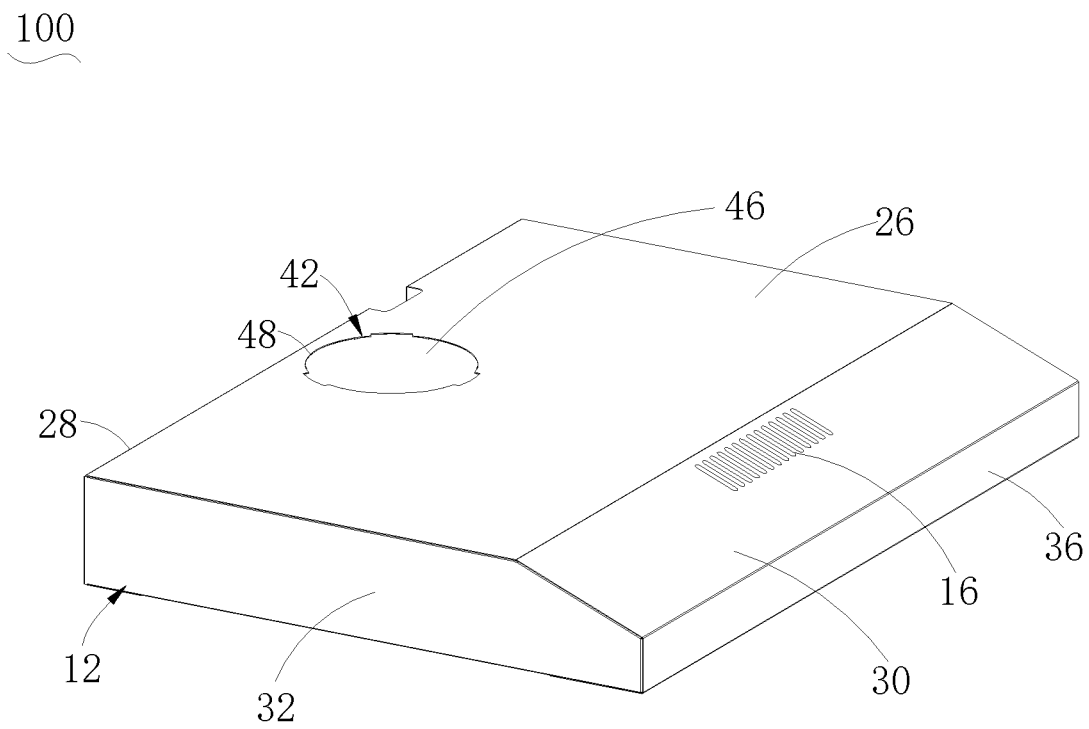
FIG. 1 to FIG. 4 are schematic diagrams showing structures of slim range hoods according to embodiments of the present disclosure.

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the drawings are illustrative only, and are intended to explain rather than limit the present disclosure.

In the description of the present disclosure, it should be understood that the orientation or position relationship indicated by the term "center", "longitudinal", "transverse", "length", "width", "thickness", "upper", "lower", "front", "rear", "left", "right", "vertical", "horizontal", "top", "bottom", "inner", "outer", "clockwise", or "counterclockwise", etc. is based on the orientation or position relationship shown in the drawing, and is only for the convenience of describing the present disclosure and simplifying the description, rather than indicating or implying that the pointed device or element must have a specific orientation, or be constructed and operated in a specific orientation, and therefore cannot be understood as a limitation of the present disclosure. In the description of the present disclosure, "plurality" means at least two, unless otherwise specifically defined.

It should be noted that, in the description of the present disclosure, unless otherwise clearly specified and limited, terms such as "mount", "connected", and "connect" should be understood in a broad sense. For example, it may be a fixed connection or a detachable connection or an integral connection; a mechanical connection or electrical connection; a direct connection or an indirect connection through an intermediate; and internal communication of two components or an interaction relationship between two components. The specific meaning of the above-mentioned terms in the present disclosure can be understood according to specific circumstances.

In the present disclosure, unless expressly stipulated and defined otherwise, the first feature being "on" or "under" the second feature may include the first feature being in direct contact with the second feature, or the first feature being not in direct contact with the second feature, but being in contact with the second feature through another feature therebetween. In one embodiment, the first feature being "above" the second feature includes the first feature being directly above or obliquely above the second feature, or simply mean that a level of the first feature is higher than a level of the second feature. The first feature being "below" the second feature may mean that the first feature is directly below or obliquely below the second feature, or simply mean that a level of the first feature is lower than a level of the second feature.

A variety of different embodiments or examples for implementing different structures of the present disclosure are provided. In order to simplify the disclosure, components and arrangements of specific examples are described herein. Of course, the specific examples are exemplary only and are not intended to limit the present disclosure. Furthermore, reference numerals and/or reference letters may be repeated in different examples of the present disclosure for the purpose of simplicity and clarity, without indicating a relationship between different embodiments and/or arrangements under discussion.

Slim range hood products have different appearances and different sizes. As a result, it is necessary to develop, based on appearance and sizes of specific products, air passage assemblies that match structural sizes of the specific products and have relevant performances, to require many different air passage-related fan assembly parts. A large number of parts leads to high investment, various development contents, and low standardization, which are not conducive to expansion of product series and iterative upgrade of product performance. In view of this, the inventors provide the embodiments of the present disclosure, in order to provide a slim range hood with high standardization, small development investment, and short development cycle, facilitating expansion of product series and iterative upgrade of product performance.

Referring to FIG. 1 to FIG. 16, a slim range hood 100 according to embodiments of the present disclosure includes a box body 12 and a fan assembly 14. The box body 12 has an internal circulation air outlet 16. The fan assembly 14 is arranged in the box body 12 and includes a volute 18 and an air guide cover 20. The volute 18 includes an air inlet part 22 and a first air outlet part 24 connected to an air outlet 221 of the air inlet part 22. The air guide cover 20 is detachably mounted at an air outlet of the first air outlet part 24 and is configured to guide an air flow sucked in by the fan assembly 14 to the internal circulation air outlet 16.

With the slim range hood 100, a design of matching the volute 18 with different air guide covers 20 is realized by mounting the detachable air guide cover 20 on the first air outlet part 24, different product structure sizes and air outlets of different sizes are satisfied, and different types of products can have the same core component. Therefore, high standardization is provided, the development investment is small, and the development cycle is short, which are conducive to expansion of product series, iterative upgrade of product performance, and company operation.

In some embodiments, when the slim range hood 100 is mounted, the fan assembly 14 is arranged horizontally. In this way, an overall thickness of the range hood is small, and an air inlet of the air inlet part 22 is directed downwards to suck air.

The box body 12 can serve as a housing of the range hood and may be made of metals, such as stainless steel. In the embodiment illustrated in FIG. 1, the box body 12 includes a top plate 26, a rear plate 28, a front plate 30, and side plates 32. The side plates 32 include a left side plate and a right side plate. The side plates 32 are connected to the front plate 30, the top plate 26, and the rear plate 28, and the top plate 26 is connected to the rear plate 28 and the front plate 30. The front plate 30 is inclined downwardly from the top plate 26, and the internal circulation air outlet 16 is provided on the front plate 30, and the air flow can exit upwardly, to avoid discomfort caused by direct blowing to a user.

Figure 2:
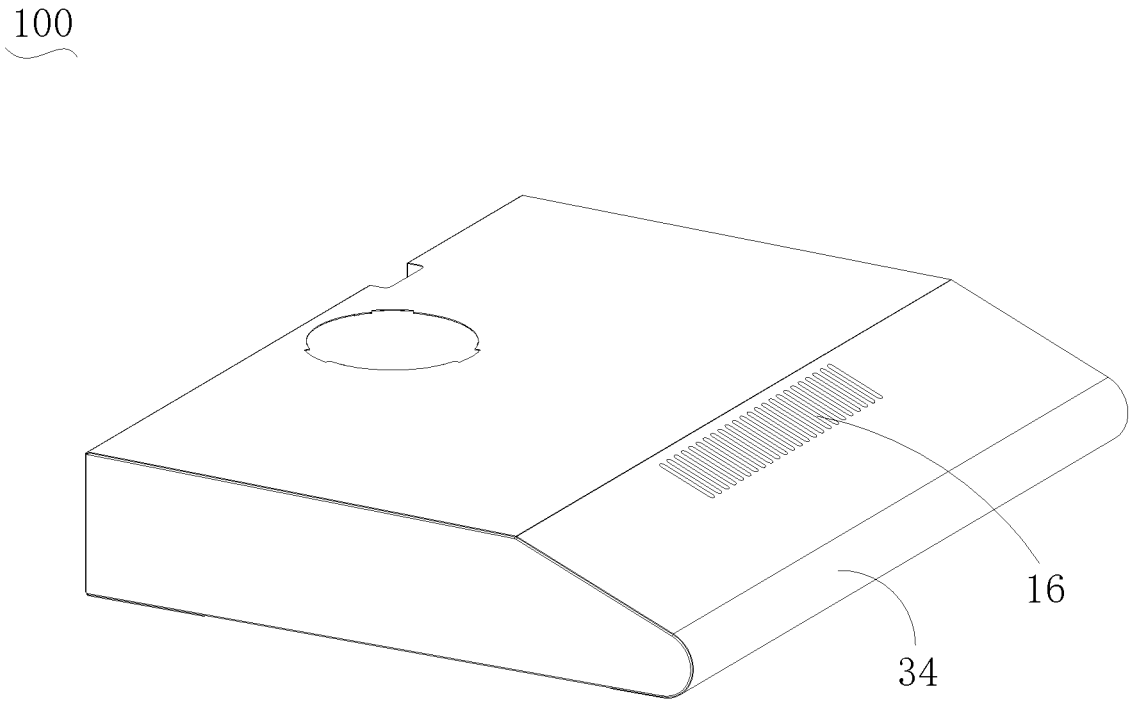
Figure 3:
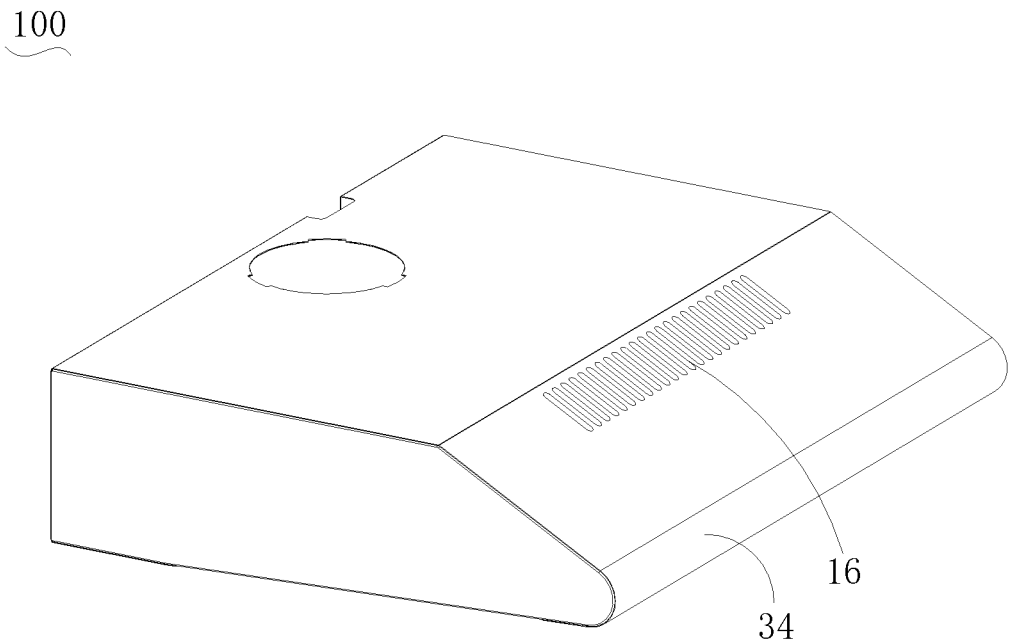
Figure 4:
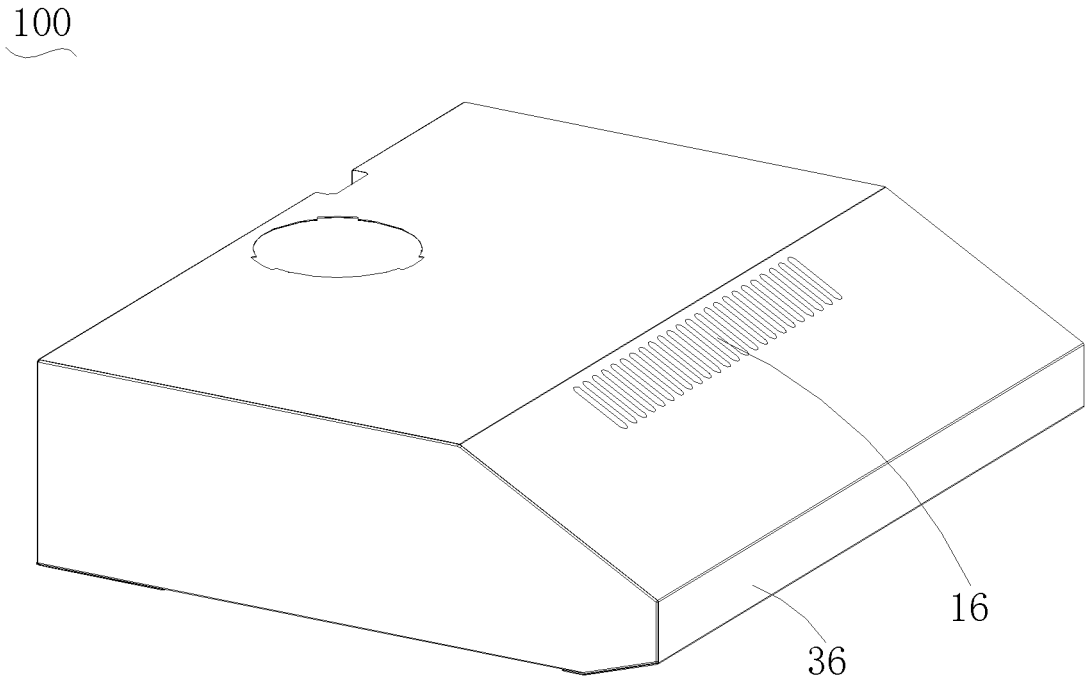

Referring to FIG. 1 to FIG. 5, the slim range hood 100 illustrated in FIG. 1 has a small overall structure size (e.g., a small thickness), the internal circulation air outlet 16 is small (e.g., an air outlet region has a small width), and an air outlet of the air guide cover 20 is also relatively small (e.g., a width of the air outlet is small). The slim range hood 100 illustrated in FIG. 2 has a large overall structure size (e.g., a large thickness), the internal circulation air outlet 16 is large (e.g., an air outlet region has a large width), and the air outlet of the air guide cover 20 is also relatively large (e.g., the width of the air outlet is large). Both the slim range hood 100 illustrated in FIG. 3 and the slim range hood 100 illustrated in FIG. 4 have a larger overall structure size (e.g., a larger thickness), the internal circulation air outlet 16 is larger (e.g., the air outlet region has a larger width), and the air outlet of the air guide cover 20 is also larger (e.g., the width of the air outlet is larger). The thickness of the slim range hood 100 illustrated in FIG. 4 is greater than the thickness of the slim range hood 100 illustrated in FIG. 3.

In FIG. 2 and FIG. 3, a lower end of the front plate 30 of the slim range hood 100 is connected to an arc-shaped plate 34. In FIG. 1 and FIG. 4, the lower end of the front plate 30 of the slim range hood 100 is connected to a flat plate 36. The two have different front side configurations, which can be adapted to more needs. It can be understood that the slim range hood 100 may have other front side configurations in other embodiments.

In some embodiments, keys and/or a display screen may be provided on the arc-shaped plate 34 or the flat plate 36 for user operations. The keys may include a knob, a press key, a sliding key, and the like. The display screen can display information such as gears of a fan 40, frying pan temperature, etc. In addition, the display screen may be a touch display screen that may display virtual keys, and the user may control the operation of the range hood through the virtual keys.

Figure 5:
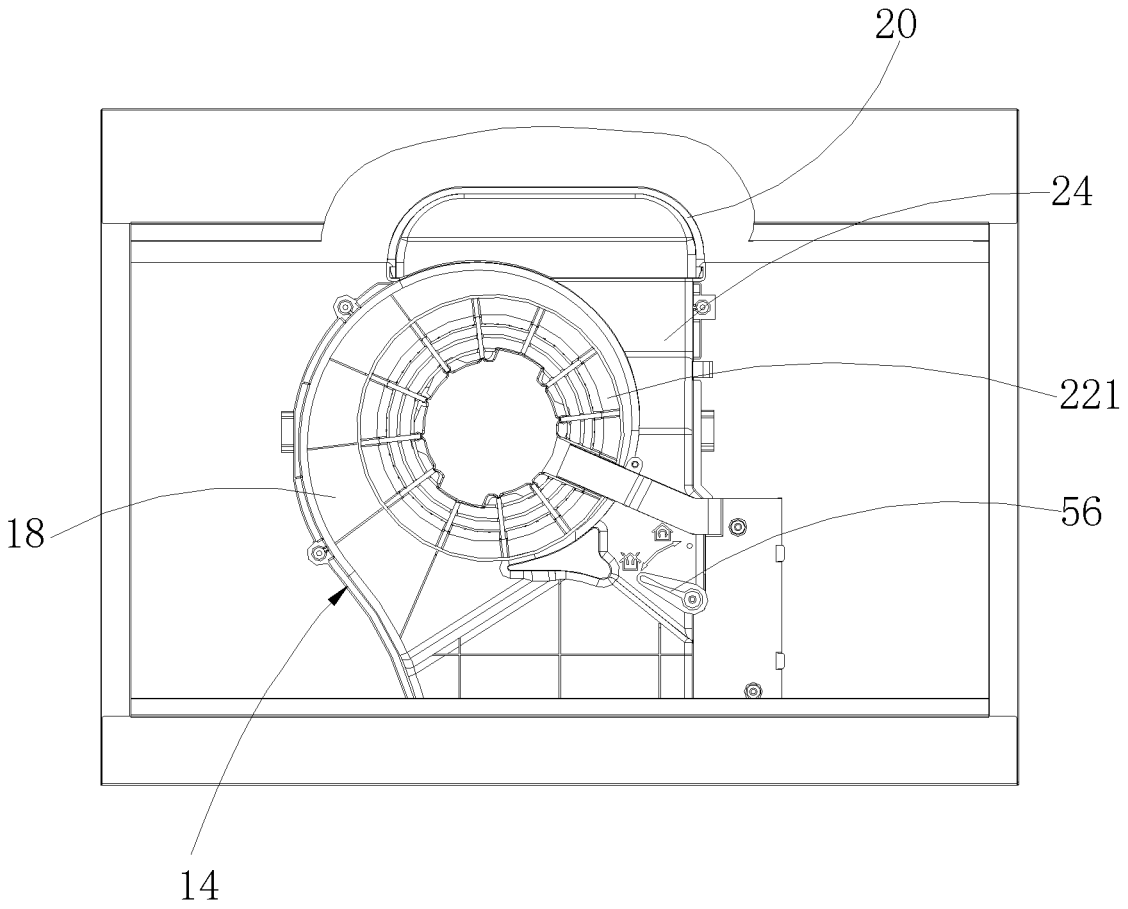
FIG. 5 is a schematic bottom view of a slim range hood according to some embodiments of the present disclosure.
Figure 6:
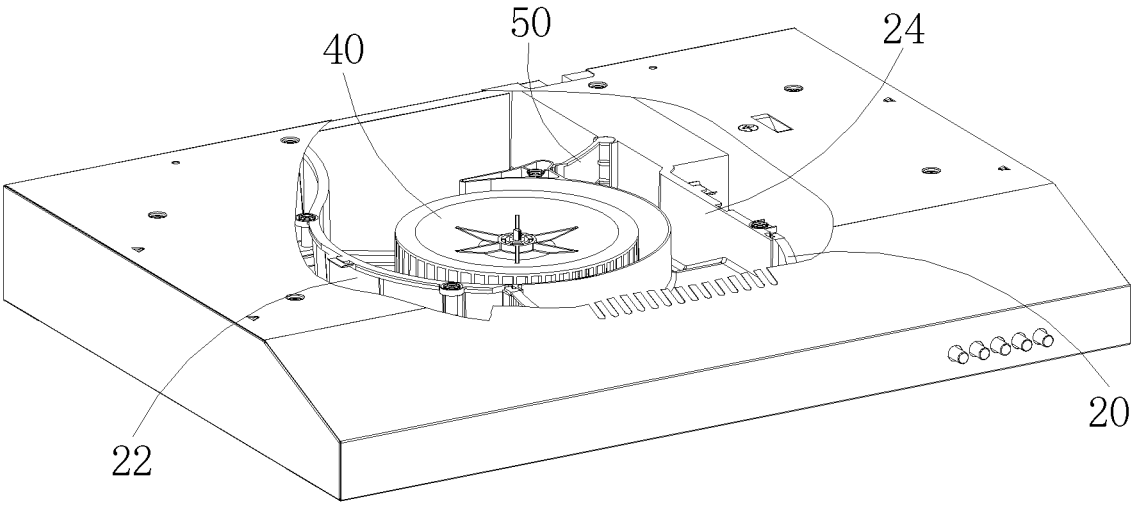
FIG. 6 is a schematic diagram showing a partial interior of a slim range hood according to some embodiments of the present disclosure.
Figure 7:
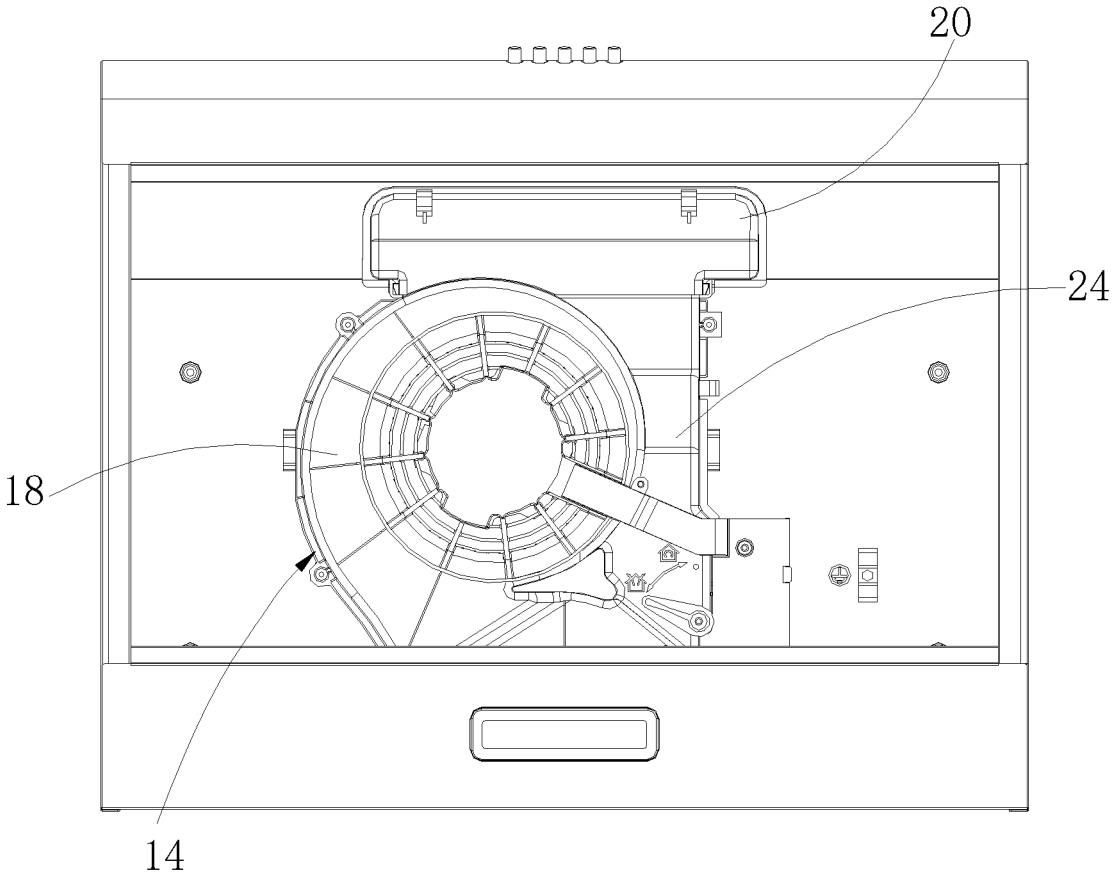
FIG. 7 is a schematic bottom view of a slim range hood according to some embodiments of the present disclosure.
Figure 8:
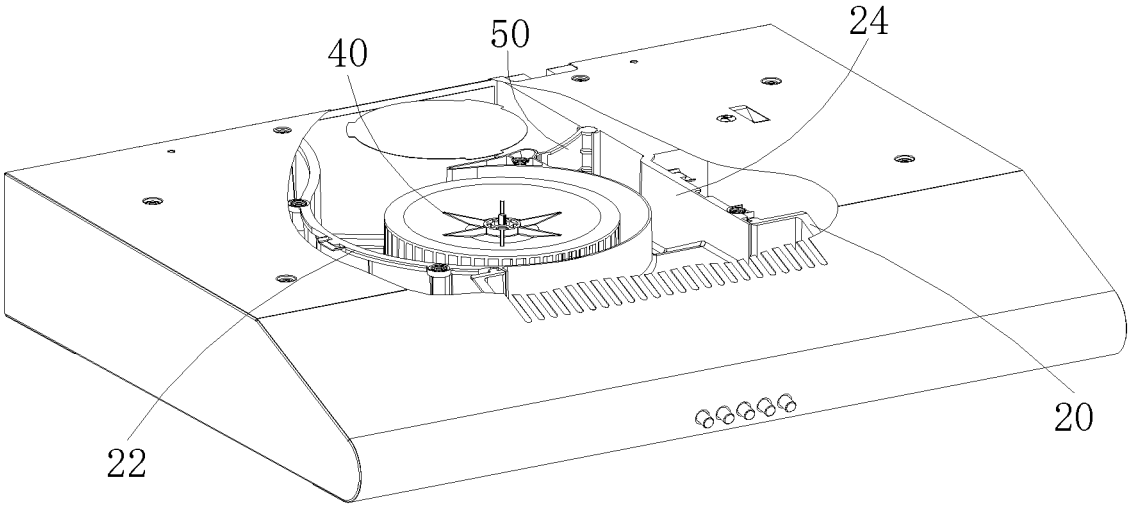
FIG. 8 is a schematic diagram showing a partial interior of a slim range hood according to some embodiments of the present disclosure.
Figure 9:
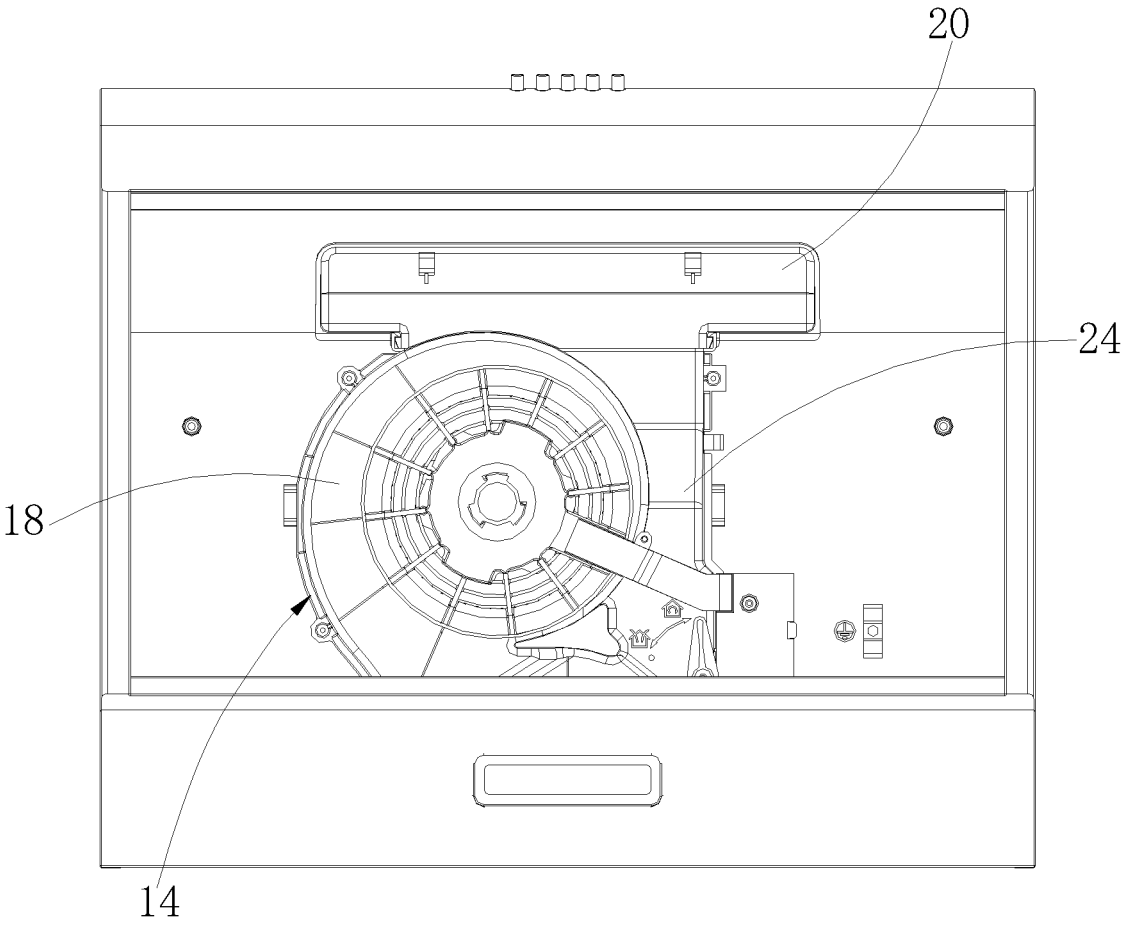
FIG. 9 is a schematic bottom view of a slim range hood according to some embodiments of the present disclosure.
Figure 10:
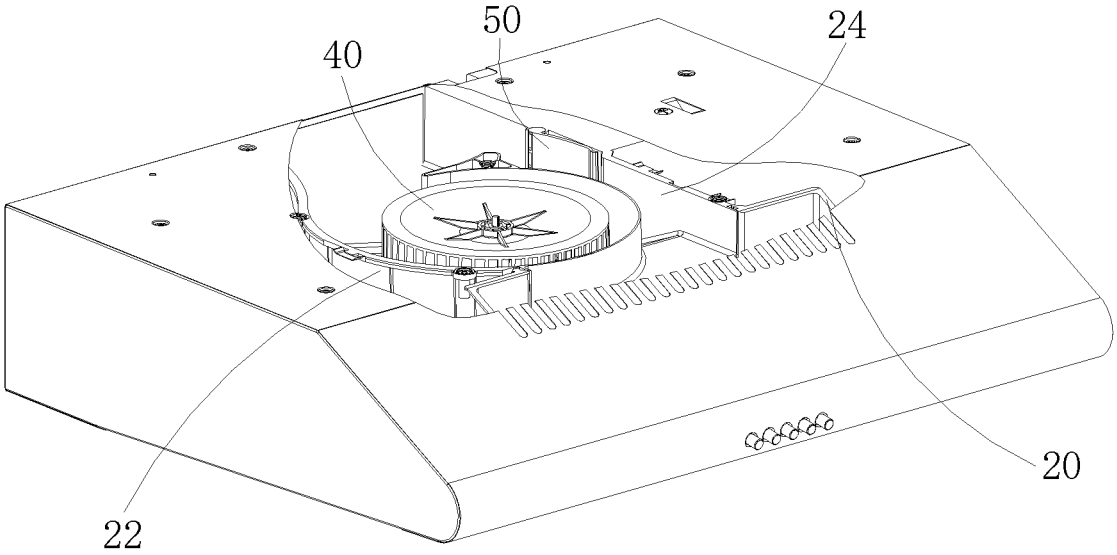
FIG. 10 is a schematic diagram showing a partial interior of a slim range hood according to some embodiments of the present disclosure.

FIG. 1, FIG. 5, and FIG. 6 illustrate slim range hoods 100 having the same appearance dimension. FIG. 2, FIG. 7, and FIG. 8 illustrate slim range hoods 100 having the same appearance dimension. FIG. 3, FIG. 9, and FIG. 10 illustrate slim range hoods 100 having the same appearance dimension.

Figure 16:
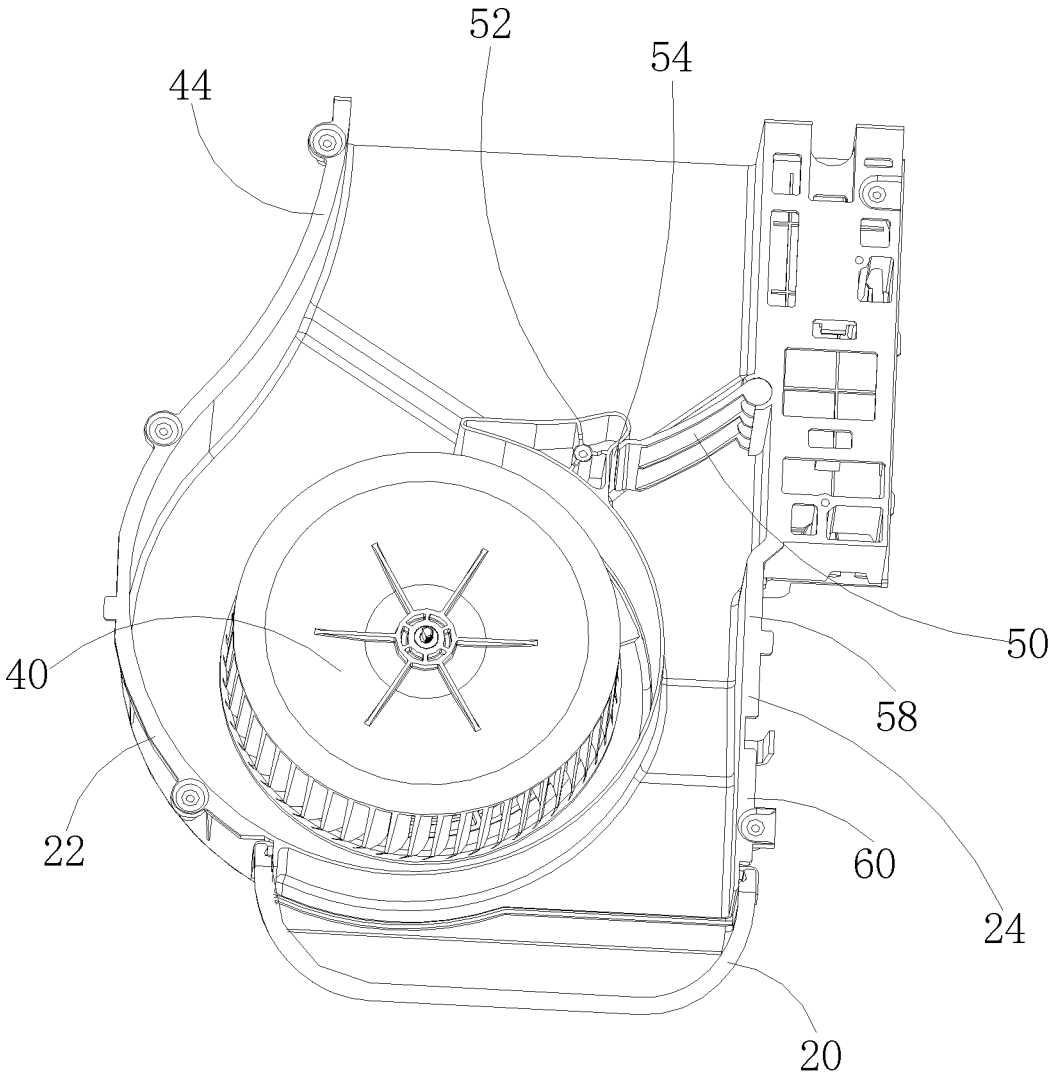
FIG. 16 is a schematic diagram showing a connection between a fan assembly and an air guide cover according to some embodiments of the present disclosure.
Figure 17:
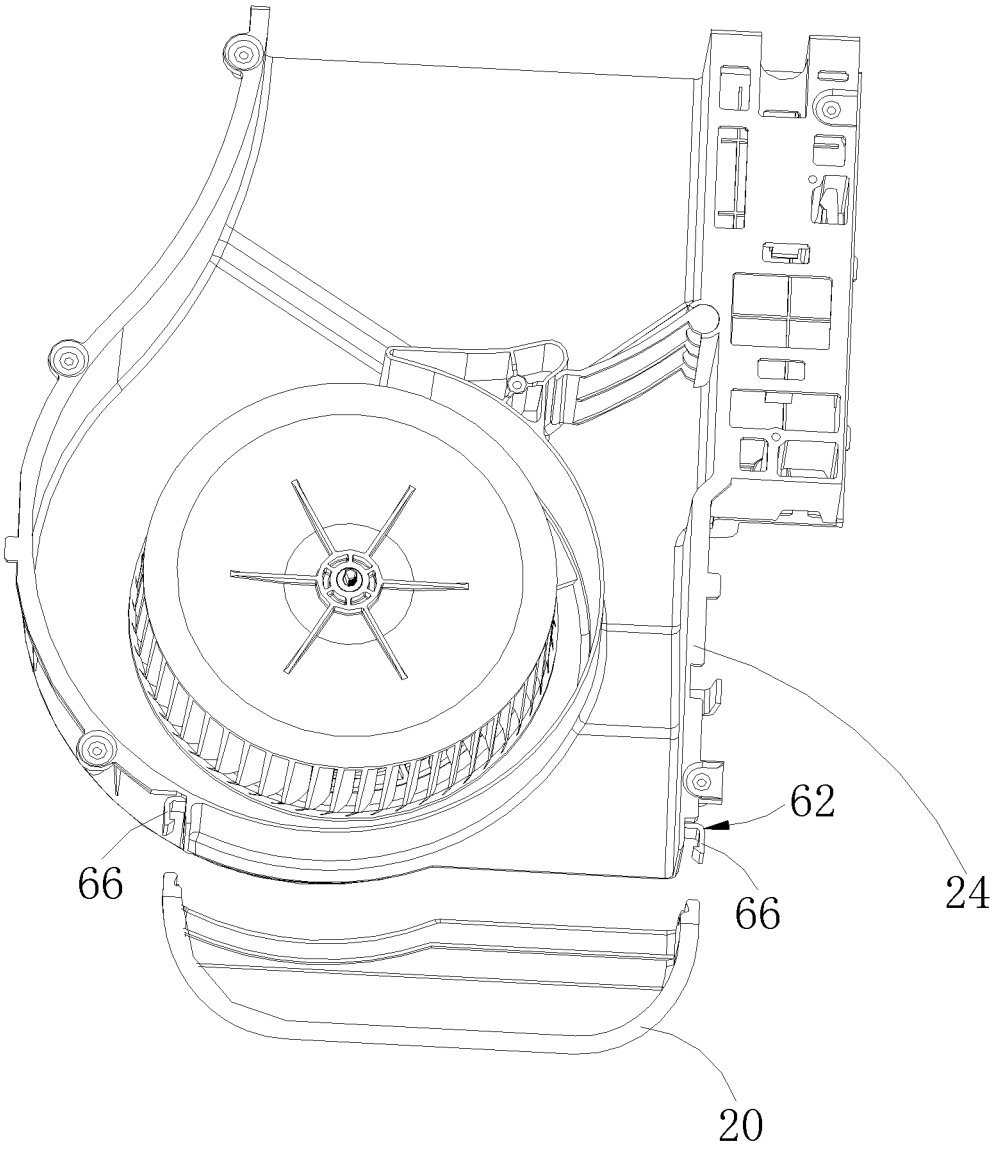
FIG. 17 and FIG. 18 are each an exploded schematic diagram of a fan assembly and an air guide cover according to some embodiments of the present disclosure.
Figure 18:
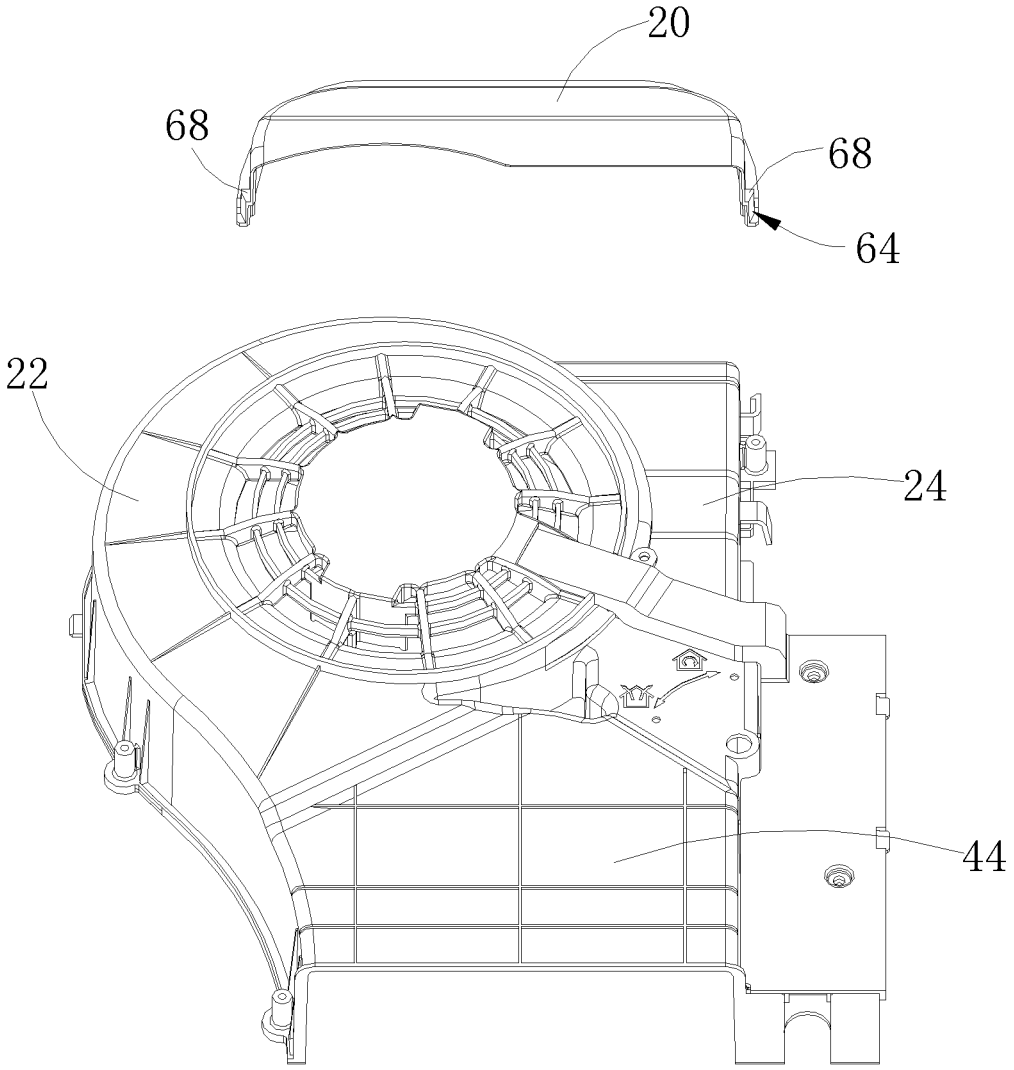
Figure 19:
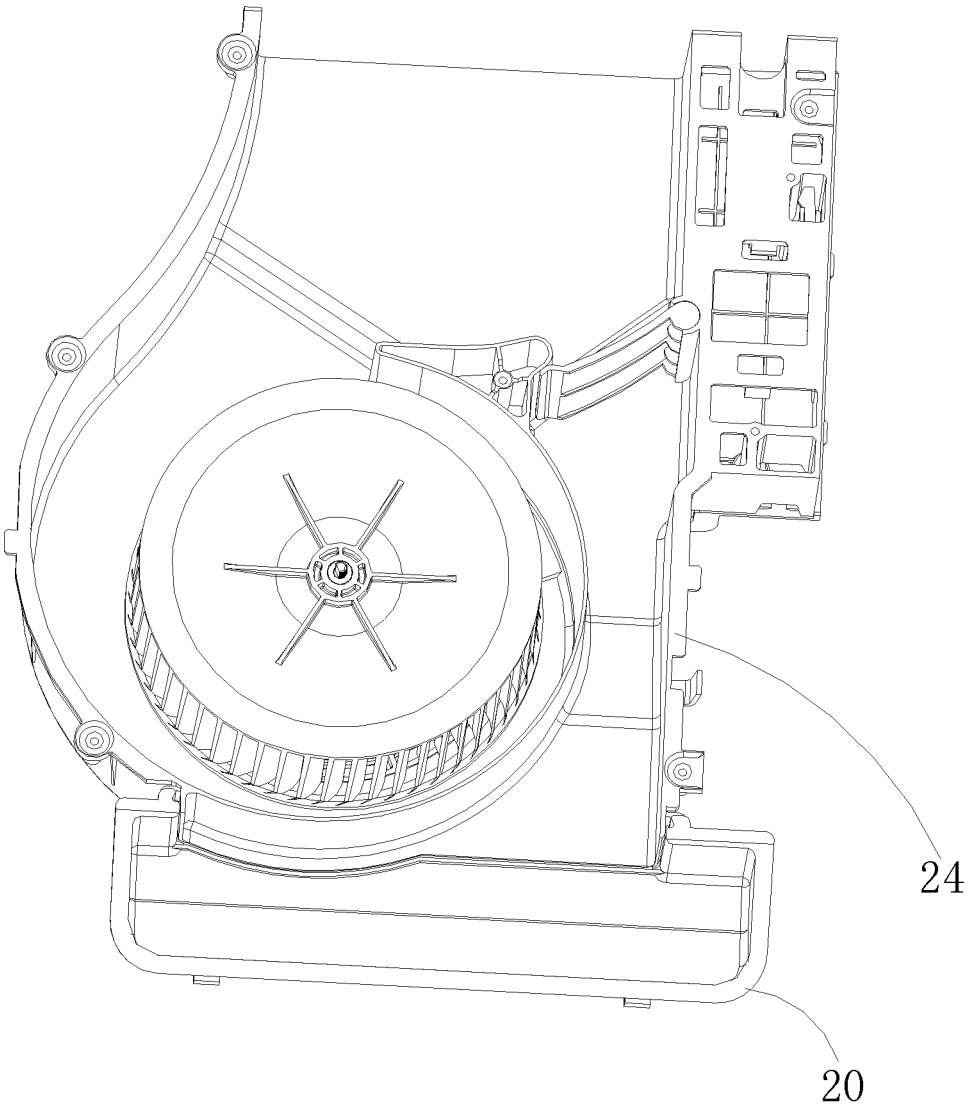
FIG. 19 is another schematic diagram showing a connection between a fan assembly and an air guide cover according to some embodiments of the present disclosure.
Figure 20:
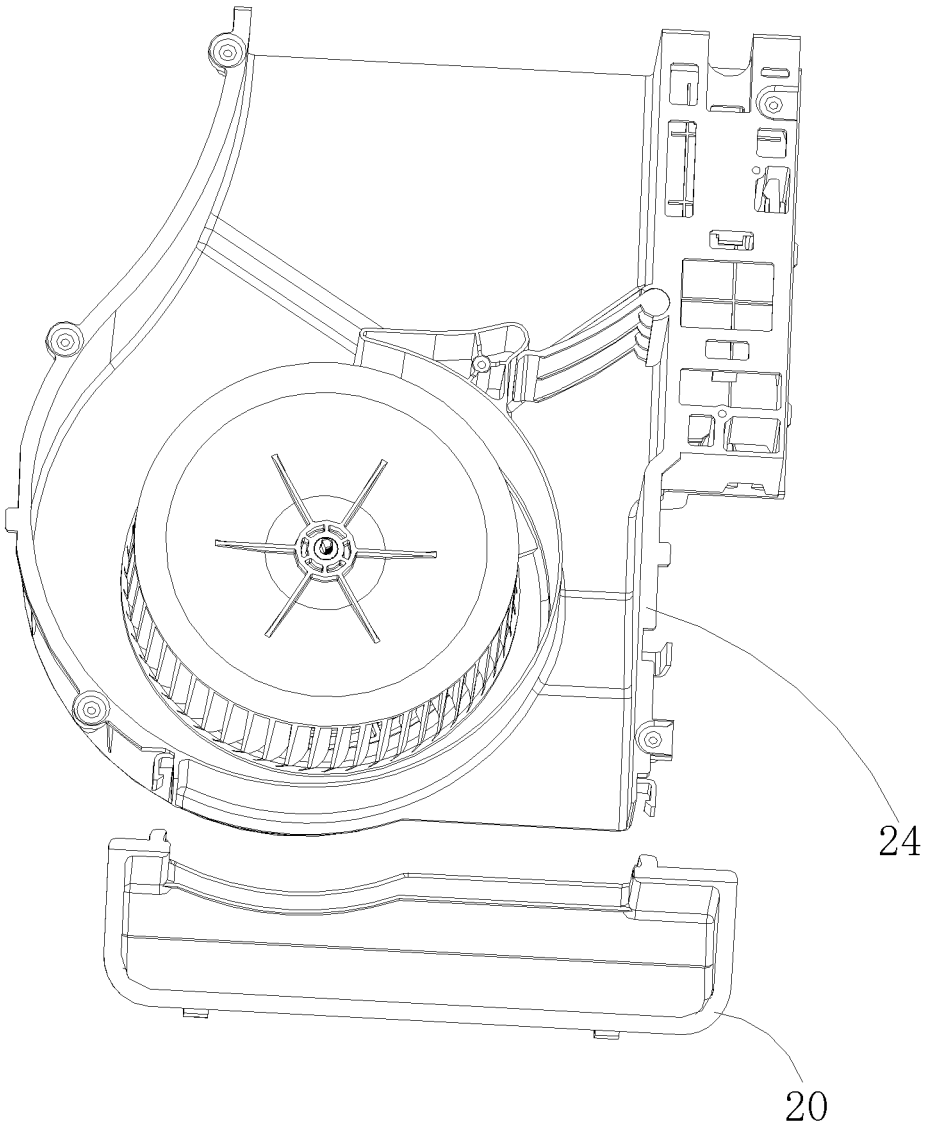
FIG. 20 and FIG. 21 are each another exploded schematic diagram of a fan assembly and an air guide cover according to some embodiments of the present disclosure.
Figure 21:
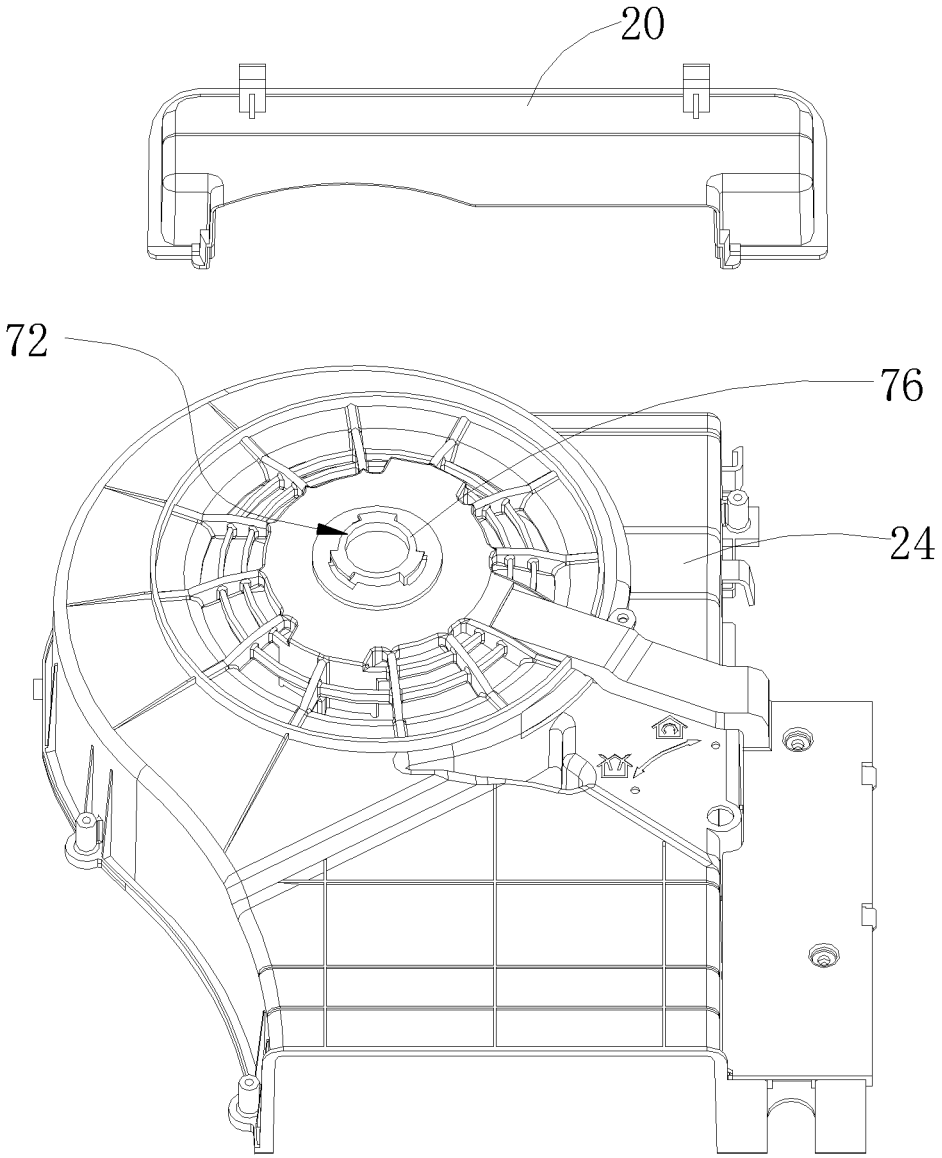
Figure 22:
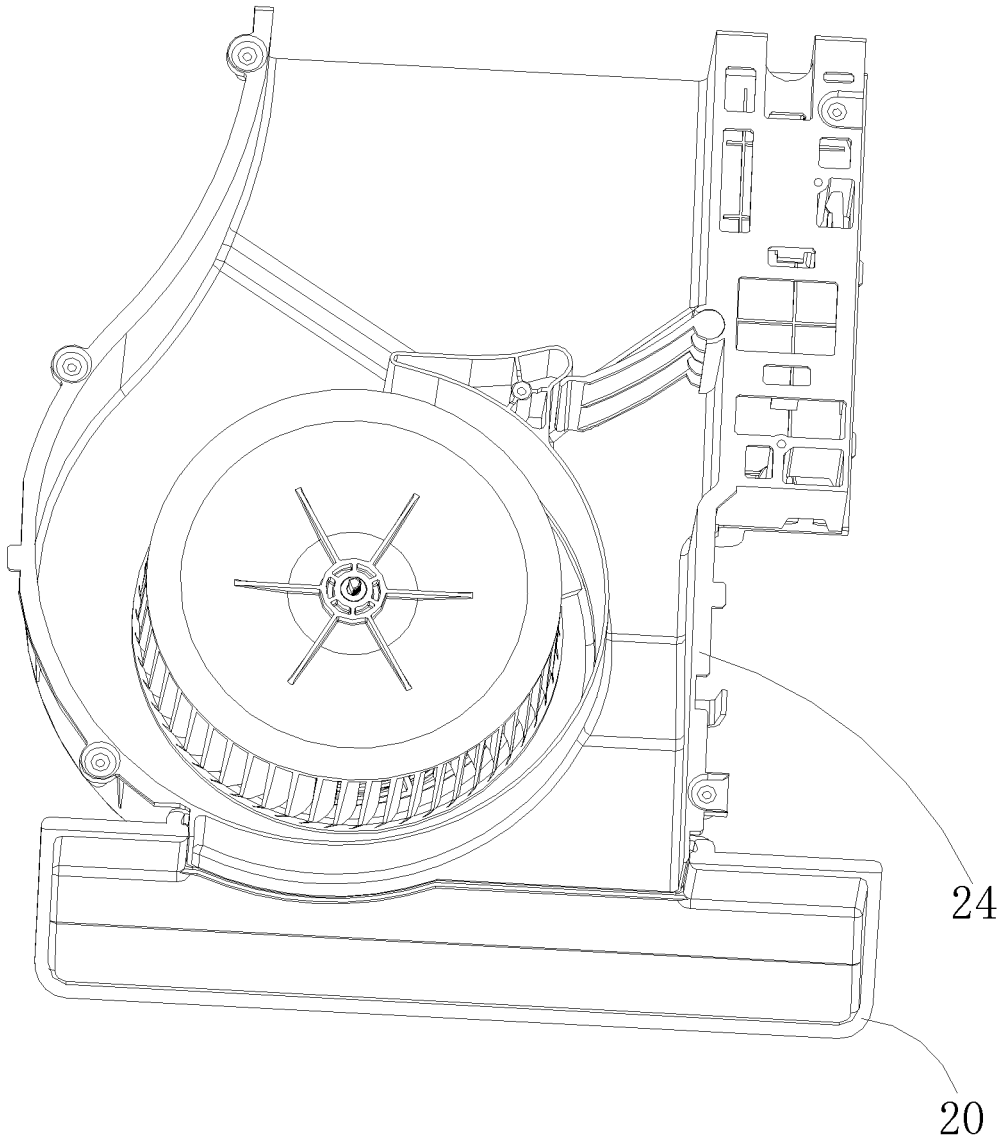
FIG. 22 is yet another schematic diagram showing a connection between a fan assembly and an air guide cover according to some embodiments of the present disclosure.
Figure 23:
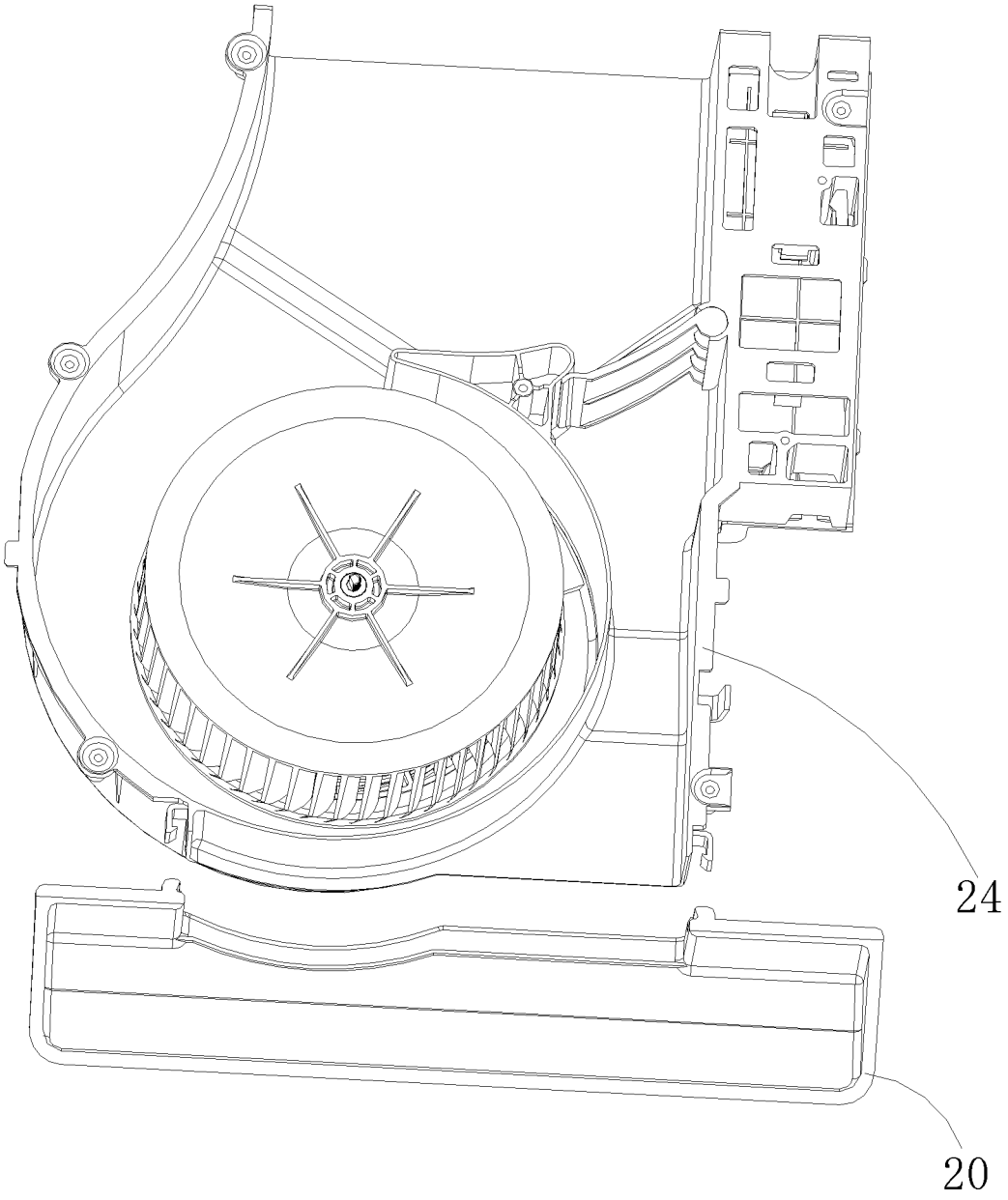
FIG. 23 and FIG. 24 are each yet another exploded schematic diagram of a fan assembly and an air guide cover according to some embodiments of the present disclosure.
Figure 24:
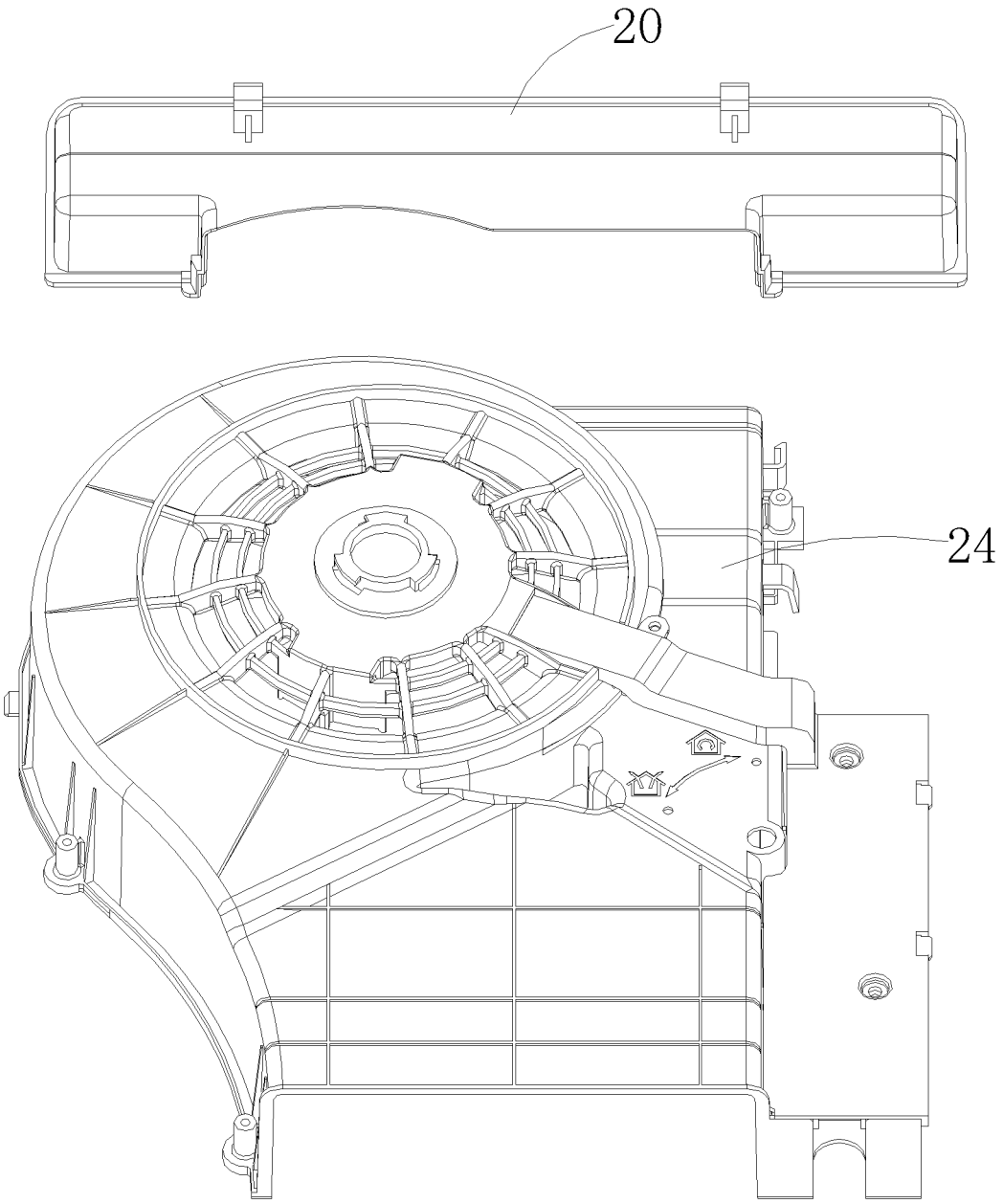
Figure 25:
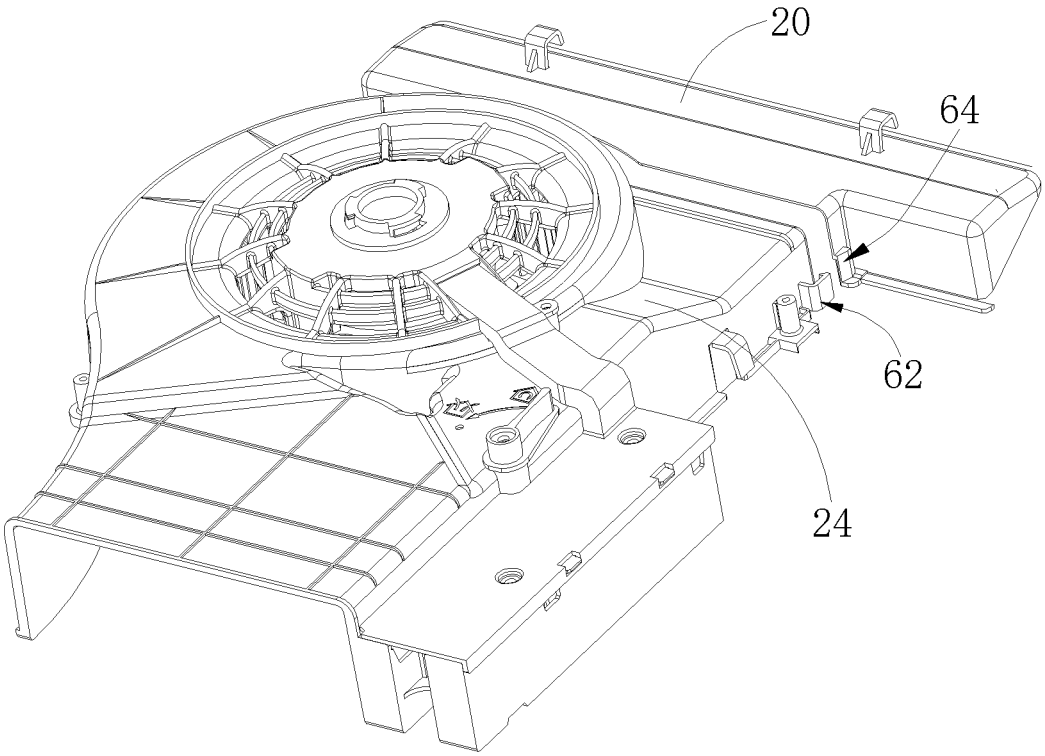
FIG. 25 is a schematic diagram showing a disconnection between a fan assembly and an air guide cover according to some embodiments of the present disclosure.
Figure 26:
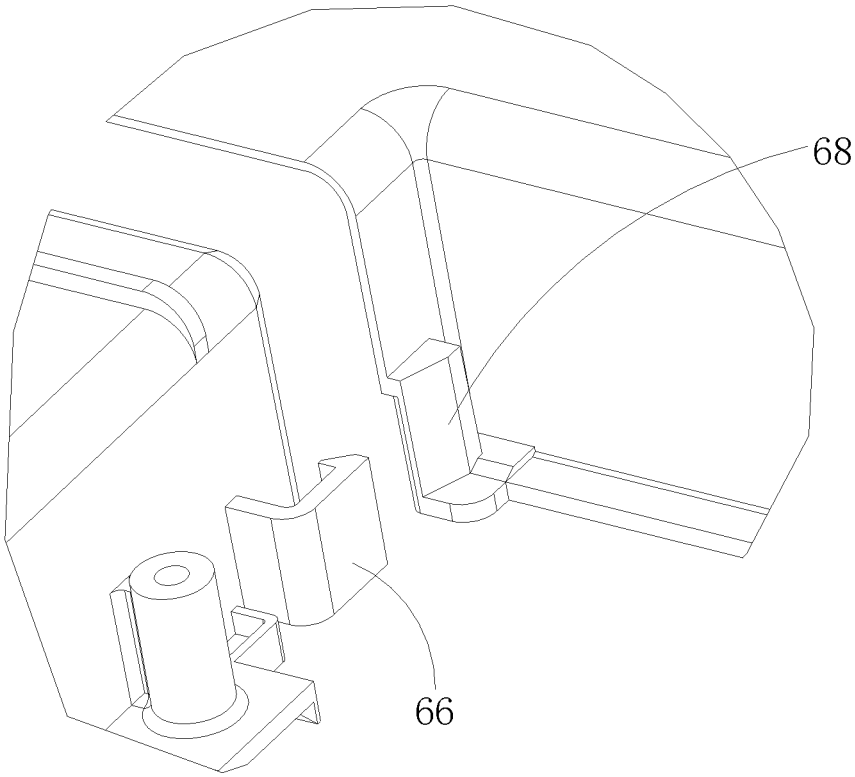
FIG. 26 is a partially enlarged schematic diagram showing a disconnection between a fan assembly and an air guide cover according to some embodiments of the present disclosure.
Figure 27:
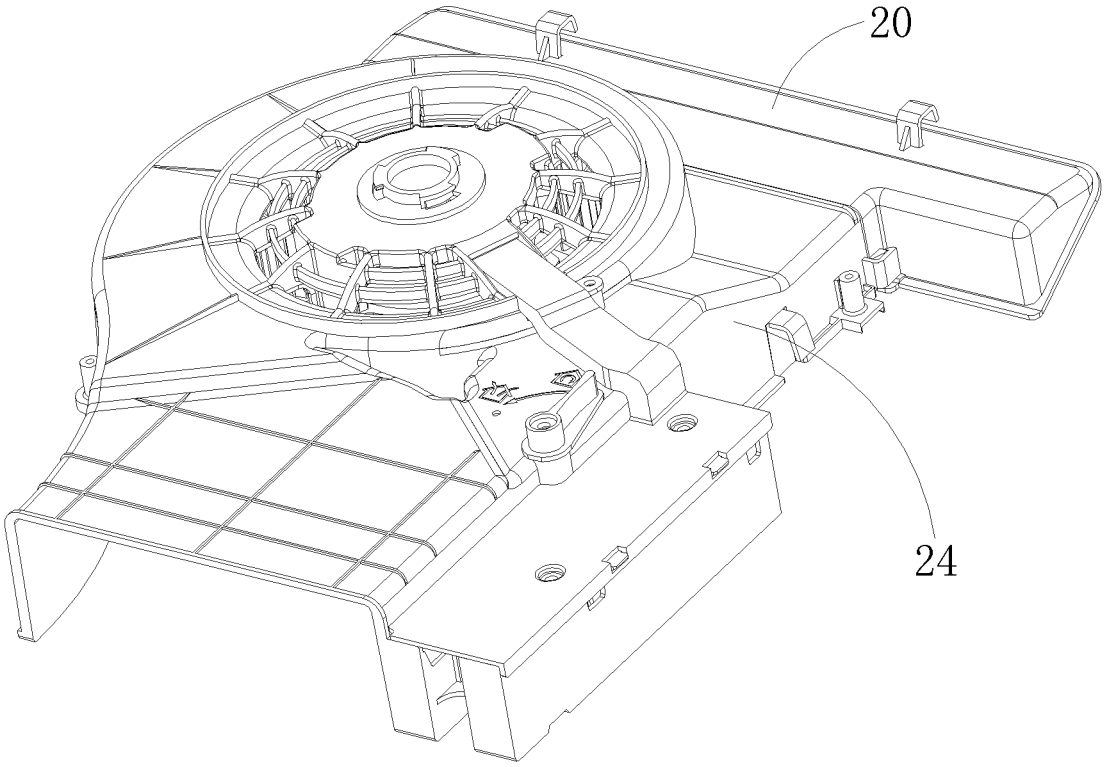
FIG. 27 is a schematic diagram showing a connection between a fan assembly and an air guide cover according to some embodiments of the present disclosure.
Figure 28:
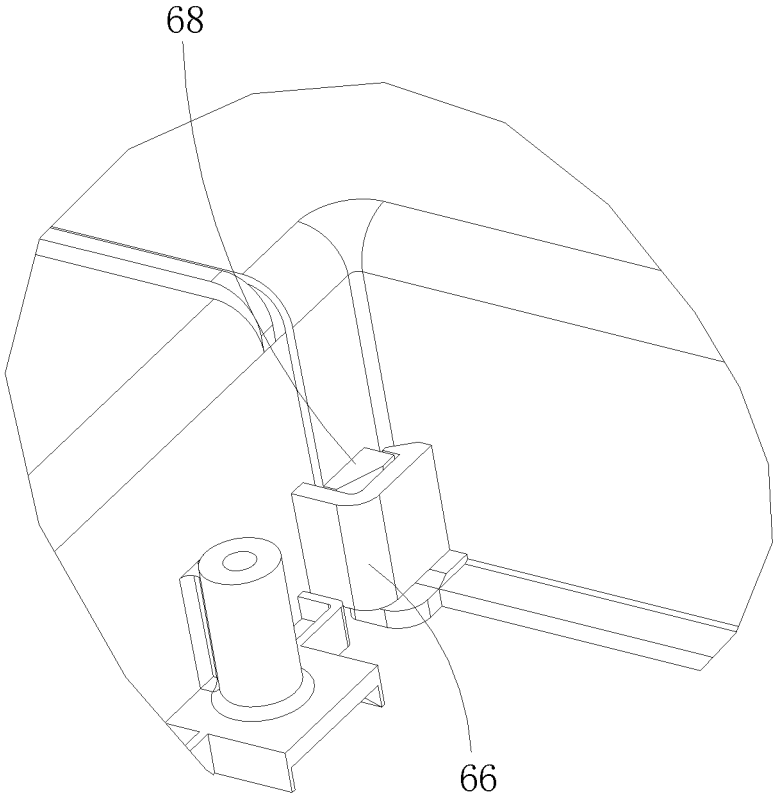
FIG. 28 is a partially enlarged schematic diagram showing a connection between a fan assembly and an air guide cover according to some embodiments of the present disclosure.
Figure 29:
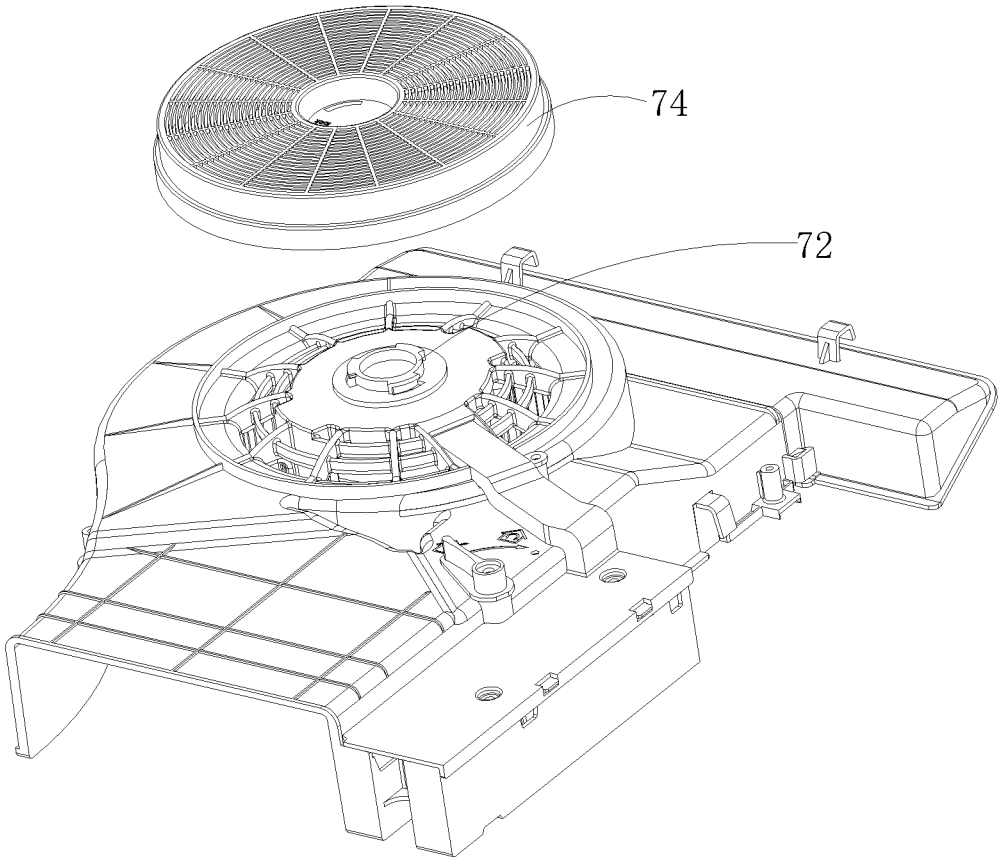
FIG. 29 is a schematic diagram showing a disconnection between a fan assembly and an active filtering assembly according to some embodiments of the present disclosure.
Figure 30:
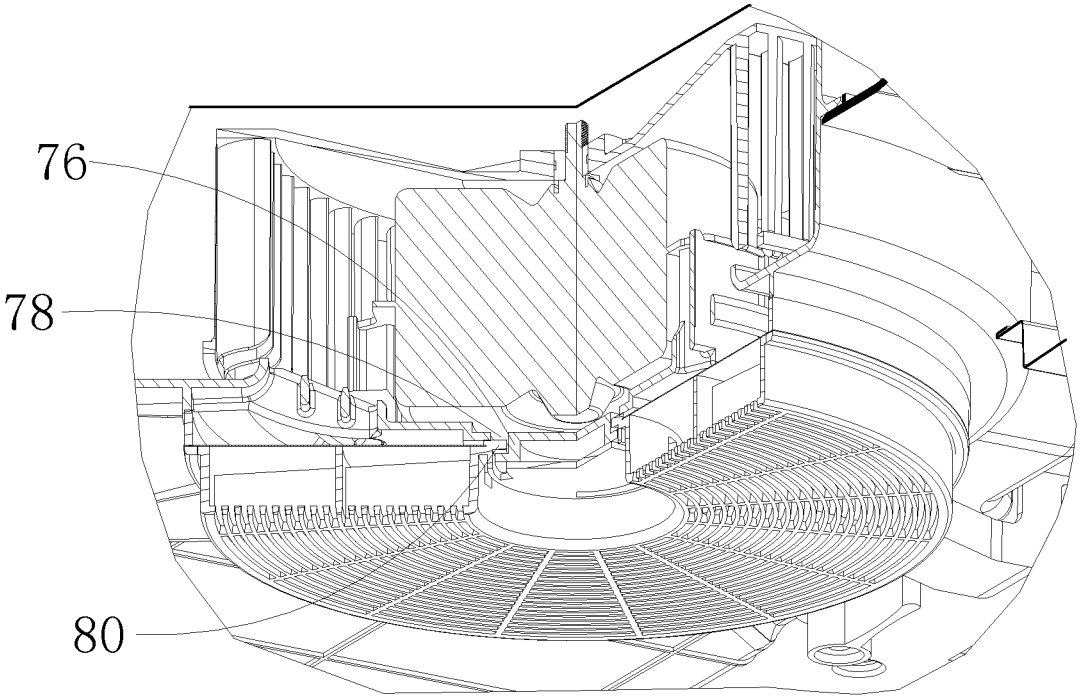
FIG. 30 is a schematic cross-sectional view of a fan assembly and an active filtering assembly according to some embodiments of the present disclosure.

FIGS. 16 to 24 illustrate air guide covers 20 suitable for different sizes of range hoods. The air guide covers 20 illustrated in FIGS. 16 to 18 are suitable for the slim range hood 100 illustrated in FIG. 1, the air guide covers 20 illustrated in FIGS. 19 to 21 are suitable for the slim range hood 100 illustrated in FIG. 2, and the air guide covers 20 illustrated in FIG. 22 to FIG. 24 are suitable for the slim range hoods 100 illustrated in FIG. 3 and FIG. 4.

The fan assembly 14 further includes the fan 40 arranged in the air inlet part 22 of the volute 18. When the fan 40 rotates, the air flow (oil fume) is sucked in from the air inlet of the air inlet part 22, and can be discharged from the internal circulation air outlet 16 through the first air outlet part 24 and the air guide cover 20.

In some embodiments, the box body 12 has an external circulation air outlet 42, the volute 18 includes a second air outlet part 44 connected to the air outlet of the air inlet part 22, and the second air outlet part 44 is configured to guide the air flow sucked in by the fan assembly 14 to the external circulation air outlet 42. In this case, operation modes of the slim range hood 100 can be increased.

In some embodiments, in the embodiments, since the box body 12 has the external circulation air outlet 42 and the internal circulation air outlet 16, the slim range hood 100 can choose to operate in an external circulation operation mode or an internal circulation operation mode. In the external circulation operation mode, the air flow sucked in by the fan assembly 14 is discharged from the external circulation air outlet 42. In the internal circulation operation mode, the air flow sucked in by the fan assembly 14 is discharged from the internal circulation air outlet 16.

It can be understood that, in other embodiments, the slim range hood 100 can choose to operate under both the external circulation operation mode and the internal circulation operation mode In some embodiments, a detachable sealing plate 46 is provided at the external circulation air outlet 42. In this way, when the slim range hood 100 operates in a non-external circulation operation mode, leakage of the oil fume can be avoided.

In some embodiments, during the mounting of the slim range hood 100, whether the slim range hood 100 operates in the external circulation condition or the internal circulation condition in the future can be selected. In a case where the slim range hood 100 operates in the external circulation operation mode, the sealing plate 46 can be removed, and a fume pipe can be connected to the external circulation air outlet 42. In a case where the slim range hood 100 operates in a non-external circulation operation mode (e.g., the internal circulation operation mode), the sealing plate 46 can be kept at the external circulation air outlet 42 to avoid accidental leakage of the oil fume.

In some embodiments, the external circulation air outlet 42 includes an upper air outlet 48 and/or a rear air outlet. In this way, the slim range hood 100 can be suitable for more user mounting sites.

In some embodiments, in some embodiments, the external circulation air outlet 42 includes the upper air outlet 48 opened on the top plate 26 and the rear air outlet opened on the rear plate 28. When leaving the factory, both the upper air outlet 48 and the rear air outlet are mounted with the detachable sealing plate 46. When the slim range hood 100 is mounted for use, the air outlet can be selected based on a mounting site of the user. For example, when the user's fume exhaust pipe is arranged above the slim range hood 100, the sealing plate 46 of the upper air outlet 48 can be removed, the sealing plate 46 of the rear air outlet can be retained, and the fume exhaust pipe can be connected to the upper air outlet 48. When the user's fume exhaust pipe is arranged at the rear of the slim range hood 100, the sealing plate 46 of the rear air outlet can be removed, the sealing plate 46 of the upper air outlet 48 can be retained, and the fume exhaust pipe can be connected to the rear air outlet.

It can be understood that, in other embodiments, the external circulation air outlet 42 includes the upper air outlet 48 or the rear air outlet. The user can make a choice based on conditions of his/her mounting site.

In some embodiments, the first air outlet part 24 is connected to the air outlet of the air inlet part 22 through the second air outlet part 44. In this way, the use of components can be reduced.

In some embodiments, the air flow discharged from the air inlet part 22 can enter an air flow passage of the first air outlet part 24 through an air flow passage of the second air outlet part 44, to avoid setting too many air outlets at the air inlet part 22.

In the embodiments, the air outlet of the air inlet part 22 is deviated from a rotation center of the fan 40, one end of the second air outlet part 44 is connected to the air outlet of the air inlet part 22, and the first air outlet part 24 is connected to the other end (an end facing away from the air outlet of the air inlet part 22) of the second air outlet part 44. When air exits from the air inlet part 22, the air flow can change its direction from the air inlet part 22 and pass through a long path before entering the first air outlet part 24, to reduce noises of the air flow.

In some embodiments, the fan assembly 14 includes a movable baffle plate 50 configured to open or close the air flow passage of the first air outlet part 24. In this way, the operation mode of the slim range hood 100 can be selected.

In some embodiments, when the internal circulation operation mode is selected, the baffle plate 50 opens the air flow passage of the first air outlet part 24. Therefore, the air flow discharged from the air inlet part 22 can enter the first air outlet part 24, and then be discharged from the internal circulation air outlet 16. When a non-internal circulation operation mode (e.g., the external circulation operation mode) is selected, the baffle plate 50 closes the air flow passage of the first air outlet part 24. Therefore, the air flow discharged from the air inlet part 22 cannot enter the first air outlet part 24, but can be discharged from the external circulation air outlet 42 (e.g., the upper air outlet and/or the rear air outlet).

Figure 13:
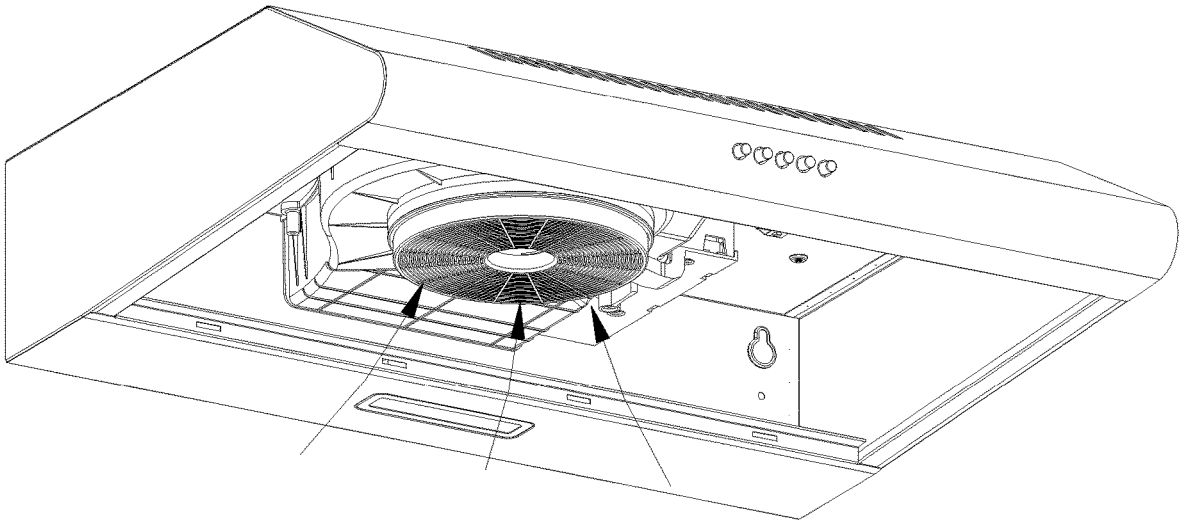
FIGS. 13 to 15 are each a schematic diagram of an oil fume path of a slim range hood according to some embodiments of the present disclosure.
Figure 14:
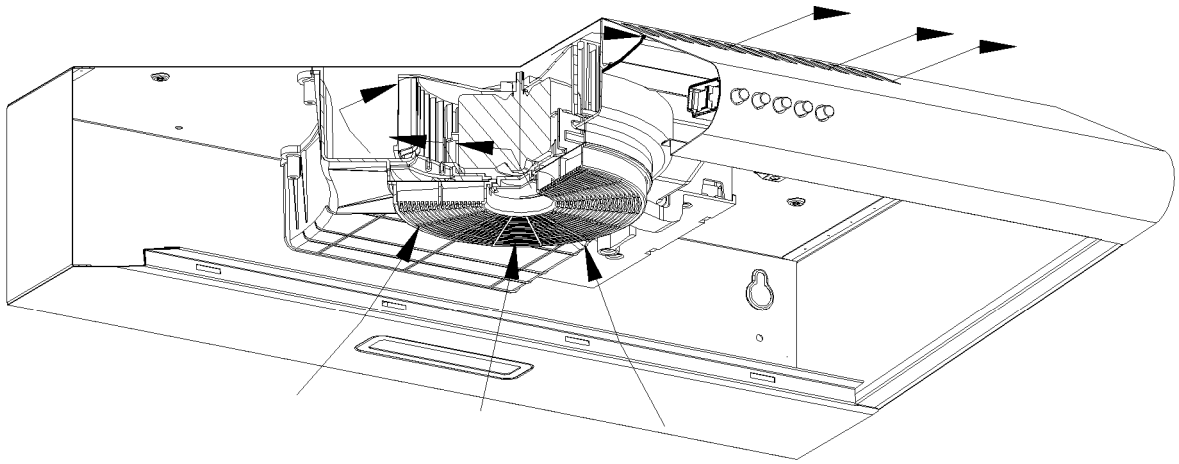
Figure 15:
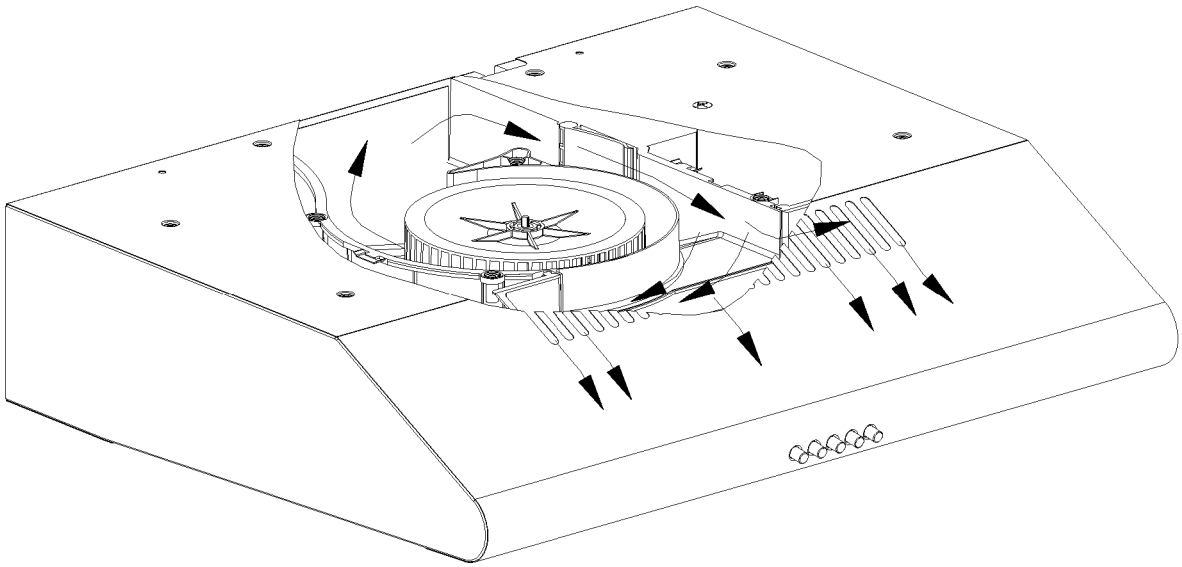

FIG. 13 to FIG. 15 illustrate a flow path of the air flow (oil fume) when the range hood 100 operates in the internal circulation operation mode, e.g., a flow path indicated by lines with arrows. In some embodiments, when the fan 40 is working, the oil fume is sucked in from the air inlet of the air inlet part 22, and discharged from the air outlet 221 of the air inlet part 22 to the second air outlet part 44, enters the first air outlet part 24, and then enters the air guide cover 20, and the air guide cover 20 diffuses the oil fume to the entire internal circulation air outlet 16.

In addition to a factor of the user's selection, the operation mode of the slim range hood 100 may be related to another factor, relevant regulations of a region or a country. For example, in some regions or countries, it is stipulated that the oil fume cannot be discharged outdoors, and the operation mode of the slim range hood 100 may be therefore limited to the internal circulation operation mode. In this case, the baffle plate 50 is opened, and the sealing plate 46 is kept at the external circulation air outlet 42, and the slim range hood 100 can operate in the internal circulation operation mode.

In the embodiments illustrated in the figures, the baffle plate 50 is rotatably arranged in the volute 18. It can be understood that, in other embodiments. In one embodiment, the baffle plate 50 is slidably arranged in the volute 18, or arranged in the volute 18 in a compound motion manner of rotation and translation, which is not specifically limited in the present disclosure.

In some embodiments, referring to FIG. 16, the volute 18 includes a volute tongue part 52, the volute tongue part 52 has a limiting groove 54 defined on an outer wall thereof, and the limiting groove 54 is configured to limit a closing position of the baffle plate 50. In this way, operations of the baffle plate 50 can be facilitated.

In some embodiments, the limiting groove 54 can limit the closing position of the baffle plate 50. During a closing process of the baffle plate 50, an end of the baffle plate 50 enters the limiting groove 54, and will be restricted by a groove wall of the limiting groove 54 when the closing of the baffle plate 50 continues, to prompt that the baffle plate 50 is in the closing position. A maximum opening position of the baffle plate 50 may be limited by inner walls of the first air outlet part 24.

In the embodiments illustrated in the figures, the first air outlet part 24 uses a partial arc-shaped wall of the air inlet part 22 as a wall of the first air outlet part 24, and a structural size of the slim range hood 100 can be reduced.

In addition, defining the limiting groove 54 on the outer wall of the volute tongue part 52 fully utilizes the structural element of the volute 18 to limit a position of the baffle plate 50, and avoids an increase in the size and cost of the slim range hood 100 caused by addition of additional structural elements.

In some embodiments, referring to FIG. 5, the fan assembly 14 includes an operating member 56 mounted outside the volute 18, and the operating member 56 is connected to the baffle plate 50 and is configured to drive the baffle plate 50 to move. In this way, the selection of the operation mode of the slim range hood 100 can be facilitated.

In some embodiments, in some embodiments, the operating member 56 may be a lever located on a lower surface of the first air outlet part 24. The baffle plate 50 can be rotated by moving the lever, and thus the air flow passage of the first air outlet part 24 can be opened or closed.

It can be understood that, in other embodiments, an electric drive device may be used to drive movements of the baffle plate 50.

As an illustration, FIG. 5 is a schematic bottom view of the slim range hood 100 illustrated in FIG. 1. In order to display the air guide cover 20, a portion of the box body 12 is hidden.

In some embodiments, the first air outlet part 24 has a shape that first contracts and then flares along an air flowing direction. In this way, the air flow can be accelerated first and then decelerated.

In some embodiments, the first air outlet part 24 may include a first part 58 and a second part 60. The first part 58 connects the second air outlet part 44 with the second part 60, and the second part 60 is connected to the air guide cover 20. When the air flow is discharged from the air inlet part 22 and enters the first part 58 through the second air outlet part 44, the air flow can decelerate and have its direction changed to reduce the noises of the air flow. When the air flow enters the first part 58 which has a contracting shape, the air flow is accelerated to shorten residence time of the air flow in the first part 58. When the air flow enters the second part 60 which has a flaring shape, the air flow is diffused to the entire region of the internal circulation air outlet 16 as much as possible while being decelerated to reduce the noises, to ensure the air discharging efficiency.

In some embodiments, referring to FIGS. 25 to 28, the first air outlet part 24 has a first snap portion 62 provided at an air outlet end thereof, the air guide cover 20 has a second snap portion 64 provided at an air inlet end thereof, and the first snap portion 62 is connected to the second snap portion 64. In this way, a detachable connection between the air guide cover 20 and the first air outlet part 24 can be realized by means of a snap connection.

In some embodiments, the first air outlet part 24 having an air outlet provided at an air outlet end thereof is universal to slim range hoods 100 of different sizes. For the slim range hoods 100 of different sizes, the internal circulation air outlets 16 have different sizes. On the one hand, the air inlet end of the air guide cover 20 matches the air outlet end of the first air outlet part 24. On the other hand, changing the size of the air outlet end of the air guide cover 20 to match the internal circulation air outlets 16 of different sizes realizes a design of matching the volute 18, a core component of the fan assembly 14, with different air guide covers, and different product structure sizes and internal circulation air outlets 16 of different sizes can be satisfied, and the core component is the same for different types of products, thus providing high standardization.

In some embodiments, the first snap portion 62 includes two snapping hooks 66 arranged on two outer sides of the air outlet end of the first air outlet part 24 respectively, the second snap portion 64 includes two snapping blocks 68 arranged on two outer sides of the air inlet end of the air guide cover 20 respectively, and the two snapping hooks 66 snap at the two snapping blocks 68. In this way, a snap connection between the first air outlet part 24 and the air guide cover 20 can be realized.

In some embodiments, the snapping hook 66 has a hook that faces towards the first air outlet part 24, and the snapping block 68 is a convex block. When mounted, the air guide cover 20 can be mounted towards the first air outlet part 24 and the snapping hook 66 is guided to a side wall of the snapping block 68 along an inclined surface of the snapping block, and finally hooks the side wall of the snapping block 68, and the snapping block 68 is located between the snapping hook 66 and an outer wall of the air guide cover 20. In addition, the snapping block 68 has a limiting part provided on a top thereof. During mounting, when the snapping hook 66 encounters the limiting part and the mounting is interrupted, it means that the air guide cover 20 is mounted in place.

It can be understood that, in other embodiments, the snap connection between the first snap portion 62 and the second snap portion 64 may be in other manners. For example, the first snap portion 62 includes the snapping block 68 and the second snap portion 64 includes the snapping hook 66; or the first snap portion 62 includes the snapping hook 66 and the second snap portion 64 includes a snapping groove; or the first snap portion 62 includes the snapping hook 66 and the snapping block 68, and the second snap portion 64 include the snapping block 68 and the snapping hook 66; etc.

In addition, the detachable connection between the air guide cover 20 and the first air outlet part 24 is not limited to the snap connection. In one embodiment, the detachable connection may be a screw connection.

In some embodiments, a width of an air outlet end of the air guide cover 20 is greater than a width of an air inlet end of the air guide cover 20. In this way, diffusion of the air flow can be achieved.

In some embodiments, the air outlet of the air guide cover 20 is provided at the air outlet end of the air guide cover 20, and the air inlet of the air guide cover 20 is provided at the air inlet end of the air guide cover 20. Referring to FIGS. 19 to 24, when a size of the internal circulation air outlet 16 is large, in order to diffuse the air flow to the entire region of the internal circulation air outlet 16 as much as possible, the width of the air outlet end of the air guide cover 20 is large to adapt to the internal circulation air outlet 16 of a large size.

Figure 11:
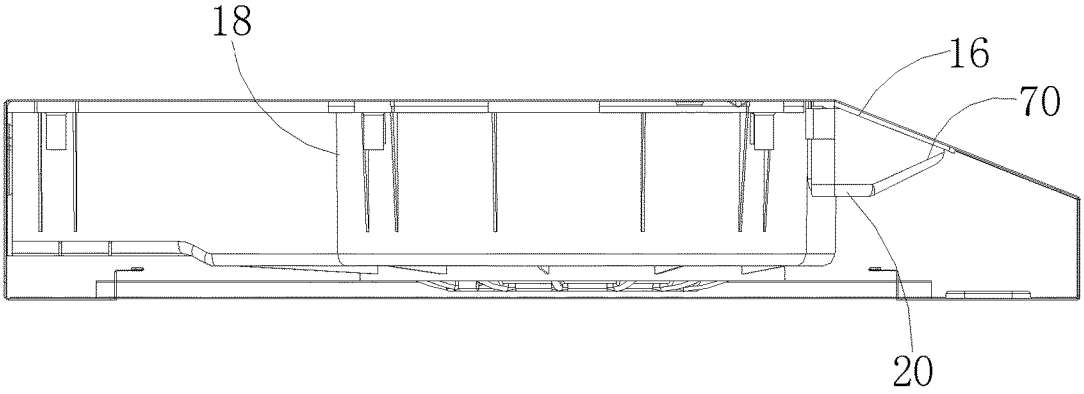
FIG. 11 and FIG. 12 are schematic cross-sectional views of a slim range hood according to some embodiments of the present disclosure.
Figure 12:
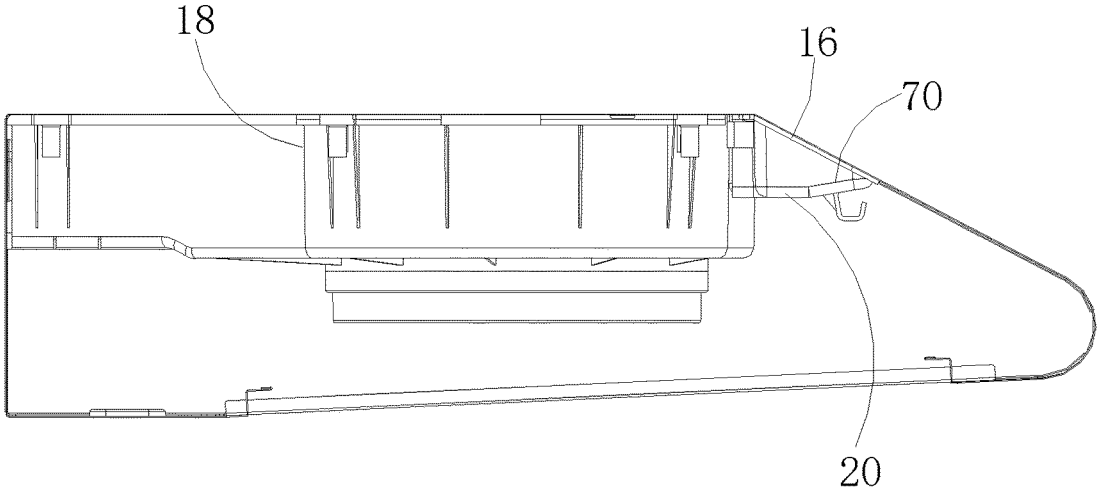

In some embodiments, referring to FIG. 11 and FIG. 12, an upwardly-inclined flow guide slope 70 is provided inside the air guide cover 20 and extends towards the internal circulation air outlet 16. In this way, the air flow can smoothly exit obliquely upwards from the slim range hood 100.

In some embodiments, the upwardly-inclined flow guide slope 70 lifts the air flow entering the air guide cover 20, and along with the downwardly-inclined front plate 30, smoothly discharges the air flow emitted from the air guide cover 20 upwardly, to avoid discomfort to the user caused by directly blowing the air flow to the user. FIG. 11 is a schematic cross-sectional view of the slim range hood 100 illustrated in FIG. 1, and FIG. 12 is a schematic cross-sectional view of the slim range hood 100 illustrated in FIG. 3 or FIG. 4.

In some embodiments, referring to FIG. 21 and FIGS. 29 to 31, the air inlet part 22 has a mounting structure 72 provided at an air inlet thereof, and the mounting structure 72 is used for mounting an active filtering assembly 74. In this way, the oil fume can be filtered.

In some embodiments, in the internal circulation operation mode of the slim range hood 100, the oil fume is discharged indoors from the internal circulation air outlet 16. When the mounting structure 72 is mounted with the active filtering assembly 74, the active filtering assembly 74 can filter the oil fume to remove odor, which on the one hand, is beneficial to the user health and user experience, and on the other hand, increases selling points of the product.

In addition, a filtering screen is mounted at the air inlet of the air inlet part 22. The filtering screen and the active filtering assembly 74 form dual filtering, to improve the user experience.

In an example, the active filtering assembly 74 may include activated carbon. Of course, the active filtering assembly 74 may include other types of active filtering assemblies 74.

The mounting structure 72 on the volute 18 can be molded by a same set of molds having a mounting structure 72, and the active filtering assembly 74 can be mounted for products having a great thickness, or the active filtering assembly 74 is not mounted for products having a small thickness, and the same volute 18 mold can meet needs of different products. Therefore, the investment is small, and the differentiated needs of different products can be satisfied.

In some embodiments, the active filtering assembly 74 is detachably mounted on the mounting structure 72. In this way, the use of the active filtering assembly 74 may be increased or decreased according to needs.

In some embodiments, if the external circulation operation mode is selected when the slim range hood 100 is mounted, since the oil fume is discharged outdoors, the active filtering assembly 74 may not be mounted at the air inlet of the air inlet part 22. In this case, the filtering screen at the air inlet of the air inlet part 22 filters the oil fume. It can be understood that even if the external circulation operation mode is selected when the slim range hood 100 is mounted. In one embodiment, the active filtering assembly 74 is mounted.

If the internal circulation operation mode is selected when the slim range hood 100 is mounted, since the oil fume is discharged indoors, the active filtering assembly 74 can be mounted at the air inlet of the air inlet part 22. In this case, the filtering screen and the active filtering assembly at the air inlet of the air inlet part 22 filter the oil fume. It can be understood that even if the internal circulation operation mode is selected when the slim range hood 100 is mounted, the active filtering assembly 74 may not be mounted.

It should be noted that the active filtering assembly 74 can be mounted on an outer side of the filtering screen, which facilitates mounting and removal of the active filtering assembly 74.

Figure 31:
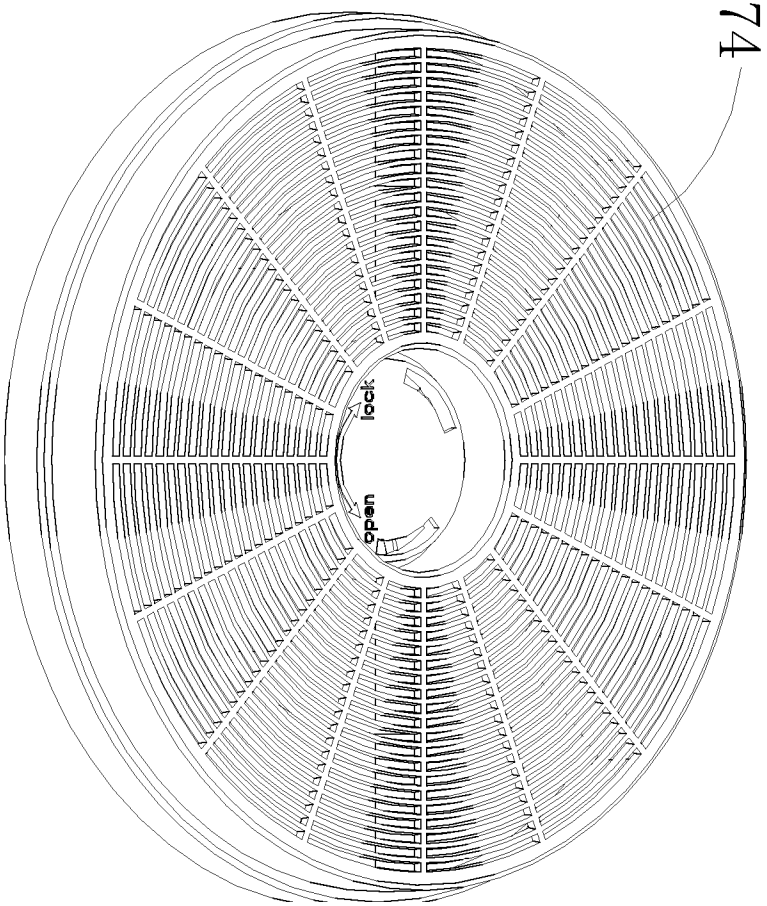
FIG. 31 is a schematic diagram showing a structure of an active filtering assembly according to some embodiments of the present disclosure.

In the embodiments illustrated in the figures, a detachable mounting manner of the active filtering assembly 74 is a rotation-snap manner. In one embodiment, the mounting structure 72 includes a columnar portion 76. The columnar portion 76 has a snapping groove 78 defined on a circumferential side surface thereof. One end of the snapping groove 78 has an opening, and the other end of the snapping groove 78 is closed. The active filtering assembly 74 has a protruding block 80 provided at a middle portion thereof. During mounting of the active filtering assembly 74, the protruding block 80 is rotated into the snapping groove 78 from the opening of the snapping groove 78 and abuts against the closed end of the snapping groove 78, to implement the mounting of the active filtering assembly 74. During removal of the active filtering assembly 74, the active filtering assembly 74 is rotated in an opposite direction to detach the protruding block 80 from the snapping groove 78, to implement the removal of the active filtering assembly 74. In FIG. 31, a clockwise direction in which the active filtering assembly 74 is rotated is a mounting direction, and a counterclockwise direction in which the active filtering assembly 74 is rotated is a removal direction.

In the description of this specification, descriptions with reference to the terms "an embodiment", "some embodiments", "illustrative embodiments", "examples", "specific examples", or "some examples", etc., mean that specific features, structure, materials or characteristics described in conjunction with the embodiment or example are included in at least one embodiment or example of the present disclosure. In this specification, the schematic representations of the above terms do not necessarily refer to the same embodiment or example. In one embodiment, the described specific features, structures, materials or characteristics may be combined in any one or more embodiments or examples in a suitable manner.

What is claimed is:

1. A slim range hood, comprising:

a box body having an internal circulation air outlet; and a fan assembly arranged in the box body and comprising a volute and an air guide cover, wherein the volute comprises an air inlet part and a first air outlet part connected to an air outlet of the air inlet part, and the air guide cover is detachably mounted at an air outlet of the first air outlet part and is configured to guide an air flow sucked in by the fan assembly to the internal circulation air outlet;

wherein an upwardly-inclined flow guide slope is provided inside the air guide cover and extends towards the internal circulation air outlet.

2. The slim range hood according to claim 1, wherein the box body has an external circulation air outlet, wherein the volute comprises a second air outlet part connected to the air outlet of the air inlet part, and the second air outlet part is configured to guide the air flow sucked in by the fan assembly to the external circulation air outlet.

3. The slim range hood according to claim 2, wherein a detachable sealing plate is provided at the external circulation air outlet.

4. The slim range hood according to claim 2, wherein the external circulation air outlet comprises an upper air outlet and/or a rear air outlet.

5. The slim range hood according to claim 2, wherein the first air outlet part is connected to the air outlet of the air inlet part through the second air outlet part.

6. The slim range hood according to claim 5, wherein the fan assembly comprises a movable baffle plate configured to open or close an air flow passage of the first air outlet part.

7. The slim range hood according to claim 6, wherein the volute comprises a volute tongue part, the volute tongue part having a limiting groove defined on an outer wall thereof, the limiting groove being configured to limit a closing position of the movable baffle plate.

8. The slim range hood according to claim 6, wherein the fan assembly comprises an operating member mounted outside the volute, the operating member being connected to the movable baffle plate and configured to drive the movable baffle plate to move.

9. The slim range hood according to claim 1, wherein the first air outlet part has a shape that contracts and then flares along an air flowing direction.

10. The slim range hood according to claim 1, wherein the first air outlet part has a first snap portion provided at an air outlet end thereof, wherein the air guide cover has a second snap portion provided at an air inlet end thereof, the first snap portion being connected to the second snap portion.

11. The slim range hood according to claim 10, wherein the first snap portion comprises a first snapping hook arranged on a first outer side of the air outlet end of the first air outlet part and a second snapping hook arranged on a second outer side of the air outlet end of the first air outlet part, the second snap portion comprises a first snapping block arranged on a first outer side of the air inlet end of the air guide cover and a second snapping block arranged on a second outer side of the air inlet end of the air guide cover, the first snapping hook snaps at the first snapping block, and the second snapping hook snaps at the second snapping block.

12. The slim range hood according to claim 1, wherein a width of an air outlet end of the air guide cover is greater than that of an air inlet end of the air guide cover.

13. The slim range hood according to claim 1, wherein the air inlet part has a mounting structure provided at an air inlet thereof, the mounting structure being mounted with an active filtering assembly.

14. The slim range hood according to claim 13, wherein the active filtering assembly is detachably mounted on the mounting structure.

* * * * *